United States Patent [19]

Gloe et al.

[11] Patent Number: 5,058,260

[45] Date of Patent: Oct. 22, 1991

[54] WIRE PROCESSING APPARATUS

[75] Inventors: Karl-Heinz Gloe, Reichelsheim; Helmut Kruezer, Munster; Harald Biehl, Bensheim, all of Fed. Rep. of Germany

[73] Assignee: AMP Incorporated, Harrisburg, Pa.

[21] Appl. No.: 580,053

[22] Filed: Sep. 10, 1990

[30] Foreign Application Priority Data

Sep. 18, 1989 [GB] United Kingdom ..... 8921114
May 30, 1990 [GB] United Kingdom ..... 9012061

[51] Int. Cl.[5] ..... H01R 43/05; H01R 43/055

[52] U.S. Cl. ..... 29/564.4; 29/566.2; 29/753; 72/418

[58] Field of Search ..... 29/33 M, 564.2, 564.4, 29/564.6, 564.8, 748, 753, 566.2; 72/418, 407

[56] References Cited

U.S. PATENT DOCUMENTS 3,070,144 12/1962 Evans ..... 72/418 X
3,588,984 8/1969 Van De Kerkhof ..... 29/203
4,852,241 8/1989 Belaidouni et al. ..... 29/564.4

*Primary Examiner*—Steven C. Bishop
*Attorney, Agent, or Firm*—Bruce J. Wolstoncroft

[57] ABSTRACT

The apparatus comprises wire gripper jaws (2, 4), a crimping die (6), a crimping anvil (7) and an insulation stripping unit (8). An insulated wire (W) is inserted between the jaws (2, 4) in an open position, between the die (6) and the anvil (7) and between stripping blades (14) of the stripping unit (8), to engage a wire sensor (26). The jaws (2, 4) then close, the stripper blades (14) close to sever the insulation of the wire (W) and the stripper unit (8) is retracted to strip the end portion (P) of the wire (W). The die (6), and the anvil (7) onto which a terminal (T) has been fed are then simultaneously moved towards each other to crimp the terminal (T) to the stripped wire end portion (P) and the jaws (2, 4) are opened and the die (6) and anvil (7) are moved apart. The wire (W) is then ejected from the jaws (2, 4) by an ejector (28).

20 Claims, 19 Drawing Sheets

V
0°
90°
180°
270°
360°

4X
300
302
2X 4X
300
W
2X
302
50
Q
304
303
306
310
308
196X
190X
188X
312
314
120X
100
311
314
200X 4X
2X
END
4X
W
2X
WIRE OUT
4X
W
2X
WIRE GRIPPED AND CRIMP
4X
W
2X
WIRE IN
4X
2X
START

WIRE PROCESSING APPARATUS

This invention relates to apparatus for stripping the insulation from an end portion of an isolated wire, and crimping an electrical terminal to the stripped end portion of the wire.

U.S. Pat. No. 3,588,984 discloses such apparatus which comprises a wire gripper unit having a pair of wire gripper jaws for gripping the wire at a position back from said end portion, a wire stripper unit for stripping the insulation from said end portion when the wire is gripped by said jaws, a crimping die and a crimping anvil which are relatively movable to crimp a terminal on the anvil to the stripped end portion of the wire and a terminal feed unit for feeding the terminal onto the anvil.

The invention is intended to provide such apparatus, in which the wire is not moved during the stripping and crimping operation and in which the movement of the parts for carrying out these operations, is reduced to a minimum. It is important that the wire should not be moved as aforesaid, because such movement could result in the misplacement of the stripped wire end in the terminal which is to be crimped thereto, with the consequent impairment of the integrity of the crimped connection.

According to one aspect of the present invention the crimping die and the crimping anvil are both movable towards each other to crimp the terminal to the stripped end portion of the wire, the wire gripper unit being fixed and the terminal feed unit being movable towards the crimping die with the anvil.

The apparatus, which is fully automatic in its operation, may be used as a bench machine to which wires are fed by an operator, or as part of a harness making assembly, comprising a lead making machine and means for feeding leads made thereby, automatically to the apparatus.

When the apparatus is in the form of a bench machine, a wire sensor is provided on the wire stripper unit so as to be actuable by the end of the wire when it has been inserted through the wire gripping jaws, to bring about the sequential cycling of the parts of the apparatus. Where the apparatus is incorporated in a larger assembly, for example a harness making assembly, cycling of said parts is initiated by a signal from a parent machine, for example the lead making machine.

The parts of the apparatus may be operated through the agency of respective cams on a common cam shaft driven by an electronically controlled DC motor, at least a first of the cams serving to operate a toggle linkage having a first toggle link connected to the crimping die and a second toggle link connected to the crimping anvil, the links being driven in opposite angular senses by means of said first cam. The crimping die and the anvil may be mounted on respective upper and lower tool holders which are slidable lengthwise on vertical rods fixed to the frame. The terminals are preferably in strip form, either in side strip, or in end strip form, a strip thereof being driven towards the crimping anvil by means of a feed finger operated by a coupling rod driven by the cam shaft.

When the terminals are in strip form, the anvil may be provided with a floating shear member operated by a shear depressor tappet which is fixed with respect to the crimping die and which shears the leading terminal on the anvil, from the strip, when the die and the anvil come together during the crimping operation. Where the terminals are connected by two carrier strips, such a shear member is provided for each carrier strip.

The wire gripper unit is preferably provided with an ejector for ejecting wire to which a terminal has been crimped, from between the jaws of the wire gripper unit, or, preferably may be arranged to dwell in a widely open position to allow the wire to be pulled out therefrom.

Means are also preferably provided for adjusting the length of the feed stroke of the feed unit in order to ensure that the carrier strip is correctly engaged thereby.

The wire stripper unit may be provided with means for ejecting stripped portions of wire insulation therefrom, with means for adjusting the stripped length of the wire, means for adjusting the insulation severing depth and means for adjusting the advanced position of the stripper unit.

According to another aspect of the invention a method of stripped the insulation from an end portion of an insulated wire and crimping an electrical terminal to the stripped end portion of the wire, comprises the steps of gripping the wire at a position back from the end portion; stripping the insulation from said end portion; and crimping an electrical terminal to the stripped end portion between a crimping die, and a crimping anvil onto which the terminal has been fed and which terminal and anvil are moved relatively towards each other along a rectilinear path; is characterized in that the wire is gripped so as to be held in a fixed position throughout the method, the die and the anvil both being moved towards each other to perform the crimping operation; and in that the terminal is fed onto the anvil by means of a terminal feed unit which is fixed to the crimping anvil and is moved therewith.

For a better understanding of the invention, an embodiment thereof will now be described by way of example with reference to the accompanying drawings in which;

FIG. 3 is a diagrammatic view taken on the lines 3—3 of FIG. 2, with parts omitted;

FIG. 8 is a vertical section of the anvil assembly and a crimping die assembly of the apparatus;

FIG. 13 is a front view, shown partly in section, of a wire stripper unit of the apparatus and part of its operating mechanism;

FIG. 23 is a graph illustrating the operation of a drive motor of said second embodiment.

The apparatus and its operation will now be described in outline with reference to FIGS. 1A to 1G.

Figure 1A:
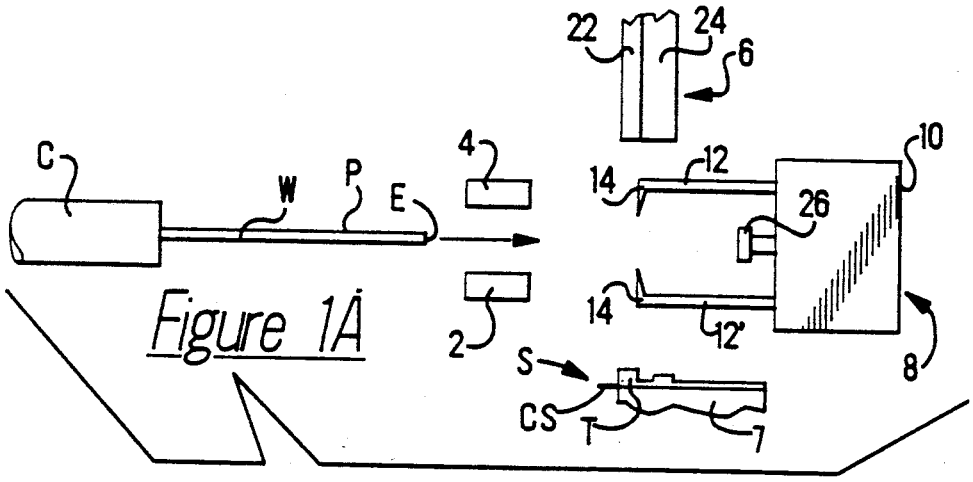
FIGS. 1A to 1F are schematic diagrams illustrating successive stages in a cycle of operation apparatus for stripping end portions of insulated electrical wires and for crimping electrical terminals to the stripped end portions of the wires.
Figure 1B:
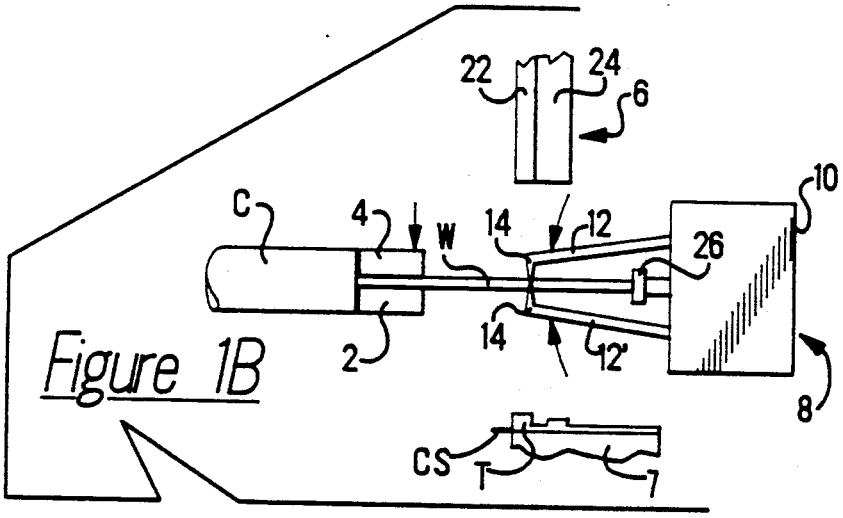

Apparatus for stripping the insulation from an end portion P of an insulated wire W and crimping an electrical terminal T to the stripped end portion P of the wire W, basically comprises a fixed wire gripper jaw 2 and movable wire gripper jaw 4, secured to the forward part of a frame of the apparatus, which frame is not shown in FIGS. 1A to 1G; a terminal crimping die 6 and a terminal crimping anvil 7 positioned in the frame rearwardly of the jaws 2 and 4 and being movable simultaneously vertically towards and away from one another whilst being horizontally fixed; and a wire stripper unit 8 comprising a support block 10 mounted rearwardly in the frame for horizontal movement between the position in which is shown in FIGS. 1A and 1B and that in which it is shown in FIGS. 1C to 1F.

Figure 1C:
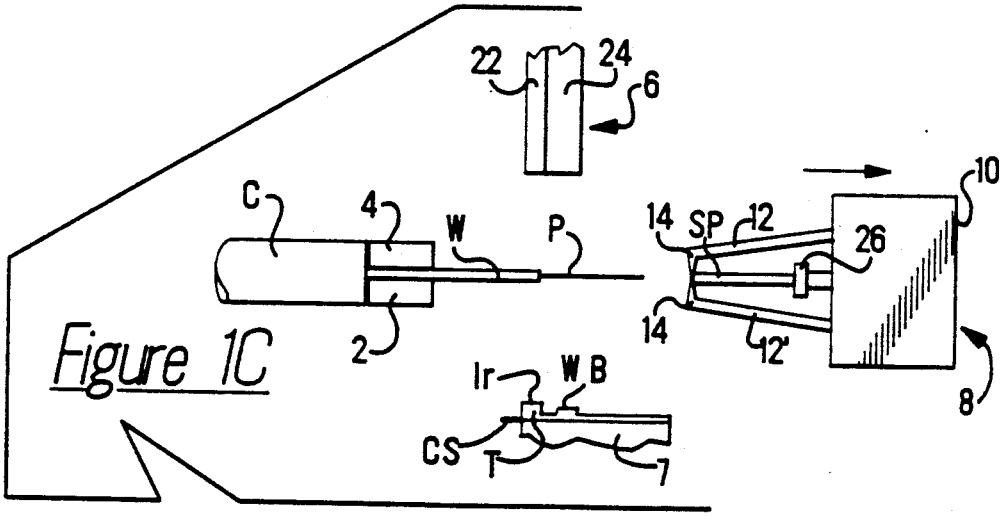
Figure 1D:
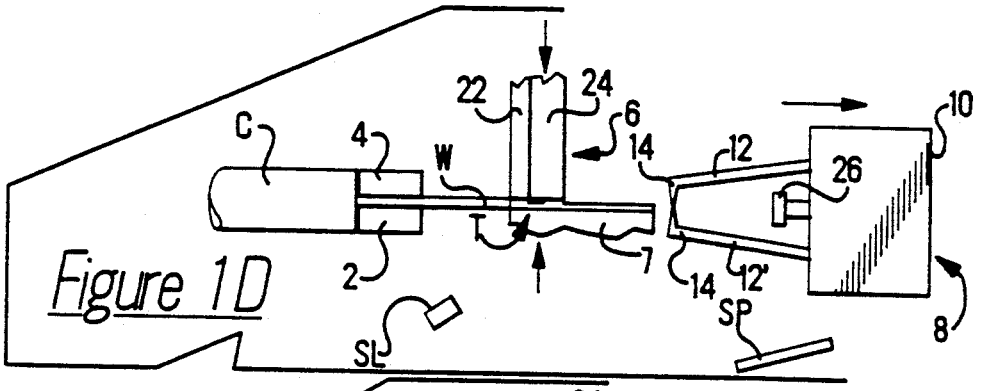

Mounted for movement towards and away from each other on the block 10 are two opposed wire stripper arms 12 and 12', which extend forwardly thereof and terminate in wire stripper blades 14 which project towards one another from the arms 12 and 12' each of which is provided with a V-shaped notch (not shown in FIGS. 1A to 1G), the apices of these notches pointing away from each other. The arms 12 and 12' are pivoted to the block 10 on pivot pins 18 and 18', respectively, a tension spring 16 (FIG. 1G) biassing the arms 12 and 12' towards a closed position in which the blades 14 overlap one another. The arms 12 and 12' can be moved to an open, wire receiving, position which is shown in FIGS. 1A and 1F, by means of a wedge lever 20 which is engageable between the rollers 20' and 20" on the arms 12 and 12' respectively. In the interest of simplifying of the diagrams of FIGS. 1A and 1G, the arms 12 and 12' are shown as being vertically relatively movable, although in practice, as described below, the arms 12 move horizontally. A terminal feed unit which moves with the anvil 7 and which is not shown in FIGS. 1A to 1G is provided for feeding a strip S of electrical terminals T, connected together in side by side relationship by means of a carrier strip CS, towards the anvil 7 in a horizontal direction.

Figure 1E:
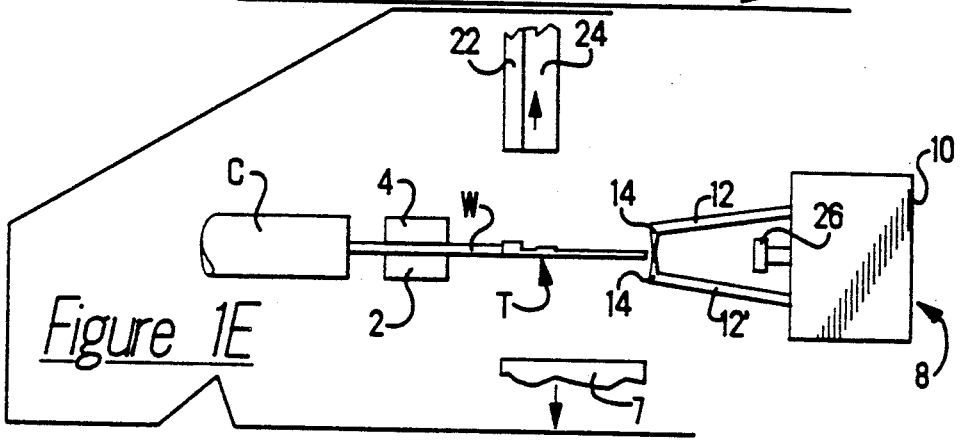
Figure 1F:
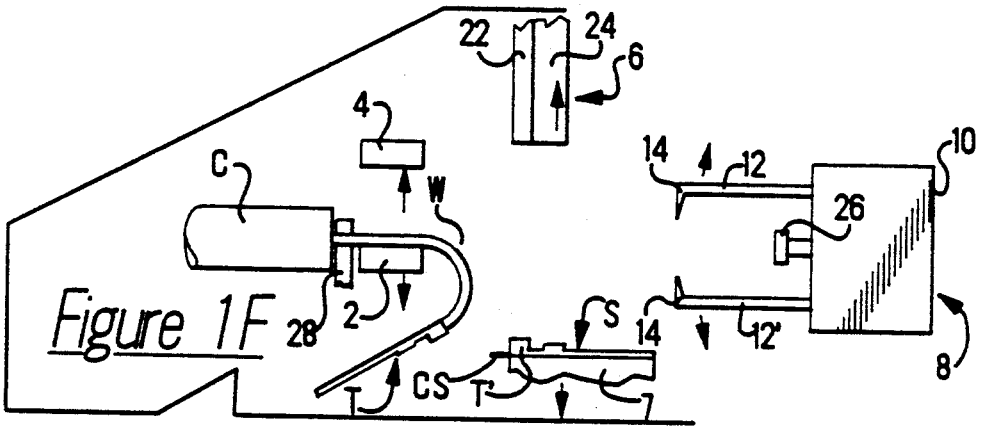
Figure 1G:
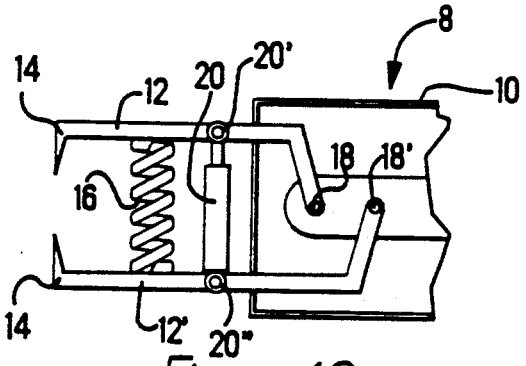
FIG. 1G is a diagram illustrating the operation of wire stripping means of the apparatus.

Prior to the beginning of a cycle of operation of the apparatus (FIG. 1A), the jaw 4 is raised above the jaw 2 so that the jaws 2 and 4 are in an open position, the die 6 and the anvil 7 which are also in an open position, being vertically displaced from one another, the wedge lever 20 being positioned between the arms rollers 20' and 20" so that the stripping blades 14 are in an open position as shown in FIG. 1G, the block 10 being in a forward, advanced position so that the open blades 14 are positioned substantially in alignment with the junction between an insulation crimper 22 and a wire crimper 24 of the die 6, and a terminal T being positioned on the anvil 7, having been advanced thereonto by a feed finger of said feed unit during the next previous cycle of operation of the apparatus, FIG. 1F. An insulated wire W of a cable C is then inserted by the operator between the open jaws 2 and 4, between the die set 6 and the anvil 7, and between the blades 14, to a predetermined extent along a horizontal wire insertion path, so that the end E of the wire W activates a wire sensor 26 between the arms 12 and 12' on the block 10 to initiate the present cycle of operation of the apparatus.

Upon the activation of the sensor 26, the jaw 4 is lowered towards the jaw 2 so that the wire W is firmly gripped between the jaws 2 and 4, and the wedge lever 20 is withdrawn from between the rollers 20' and 20" so that the blades 14 close about the insulation of the wire W under the action of the spring 16, whereby the edges of the V-shaped notches in the blades 14 sever the insulation of the wire W, as shown in FIG. 1B. As the jaw 4 is lowered, the feed finger of the feed unit is retracted to engage the strip S at an upstream position, in preparation for advancing the strip S again. The wire stripper unit 8 is now retracted rearwardly, to the position in which it is shown in FIG. 1C whereby the blades 14 drag the severed portion SP of the insulation from the end portion P of wire W thereby stripping it to expose the central conductive core C of the wire W. As the cycle of operation continues, the die 6 and anvil 7 are moved simultaneously towards each other, as shown in FIG. 1D so that the terminal T on the anvil 7 receives the stripped portion P of the wire W in an open wire barrel WB of the terminal T, the end portion of the insulation of the wire W being received in an open insulation barrel 1B of the terminal T, and the barrels WB and 1B being crimped to their respective portions of the wire W between the crimpers 24 and 22, respectively, and anvil 7, as they are moved towards one another to a fully closed position during the crimping operation a slug SL of the carrier strip CS is sheared out to sever the terminal T therefrom, by means on the die set 6 and means associated with the anvil 7, as described below.

The die set 6 and the anvil 7 now are moved away from one another (FIGS. 1E). The jaw 4 is now raised as shown in FIG. 1F so that wire W with the terminal T crimped thereto are free to be ejected from the apparatus by means of a wire ejector 28 which is pivoted to the jaw 4 and which is driven against the wire W in a direction perpendicular to its axis as the jaw 4 is raised. As the jaw is being raised, the terminal feed unit is actuated to advance a further terminal T on to the anvil 7, and, the wedge lever 20 is advanced to open the blades 14. The wire stripper unit 8, being returned to its advanced forward position.

Instead of the wire W being fed to the apparatus by an operator, it could, where the apparatus forms part of a larger assembly, for example a harness making machine, be fed automatically to the apparatus by means, for example, of a lead making machine of the assembly, in which case, the sensor 26 would be omitted, each cycle of the apparatus being initiated by means of a control signal supplied by the lead making machine upon full insertion of a wire W between the jaws 2 and 4.

Parts of the apparatus will now be described in general mainly with reference to FIGS. 2 to 6.

Figure 2:
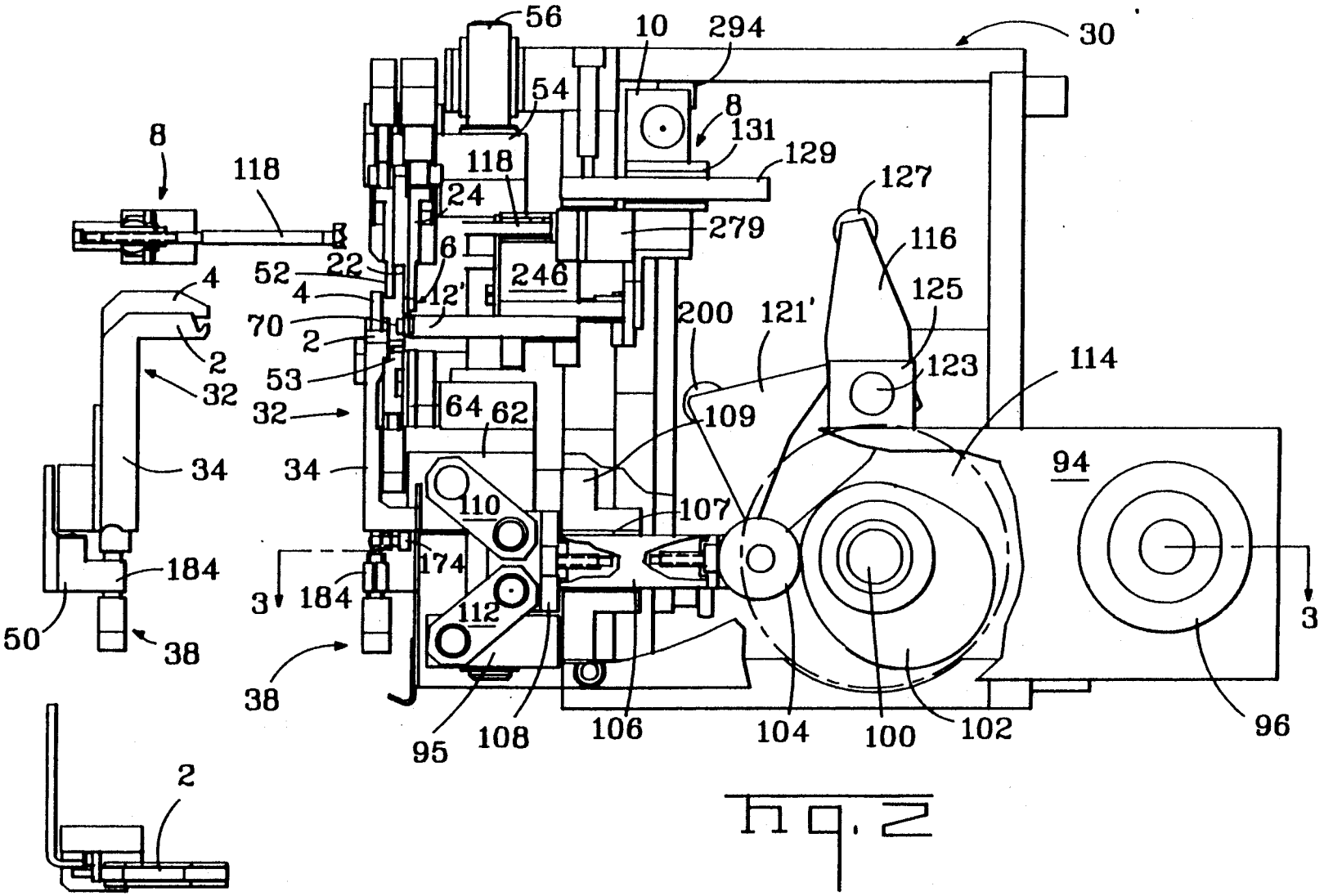
FIG. 2 is a diagrammatic, partially exploded, side view of the apparatus with parts omitted.
Figure 7:
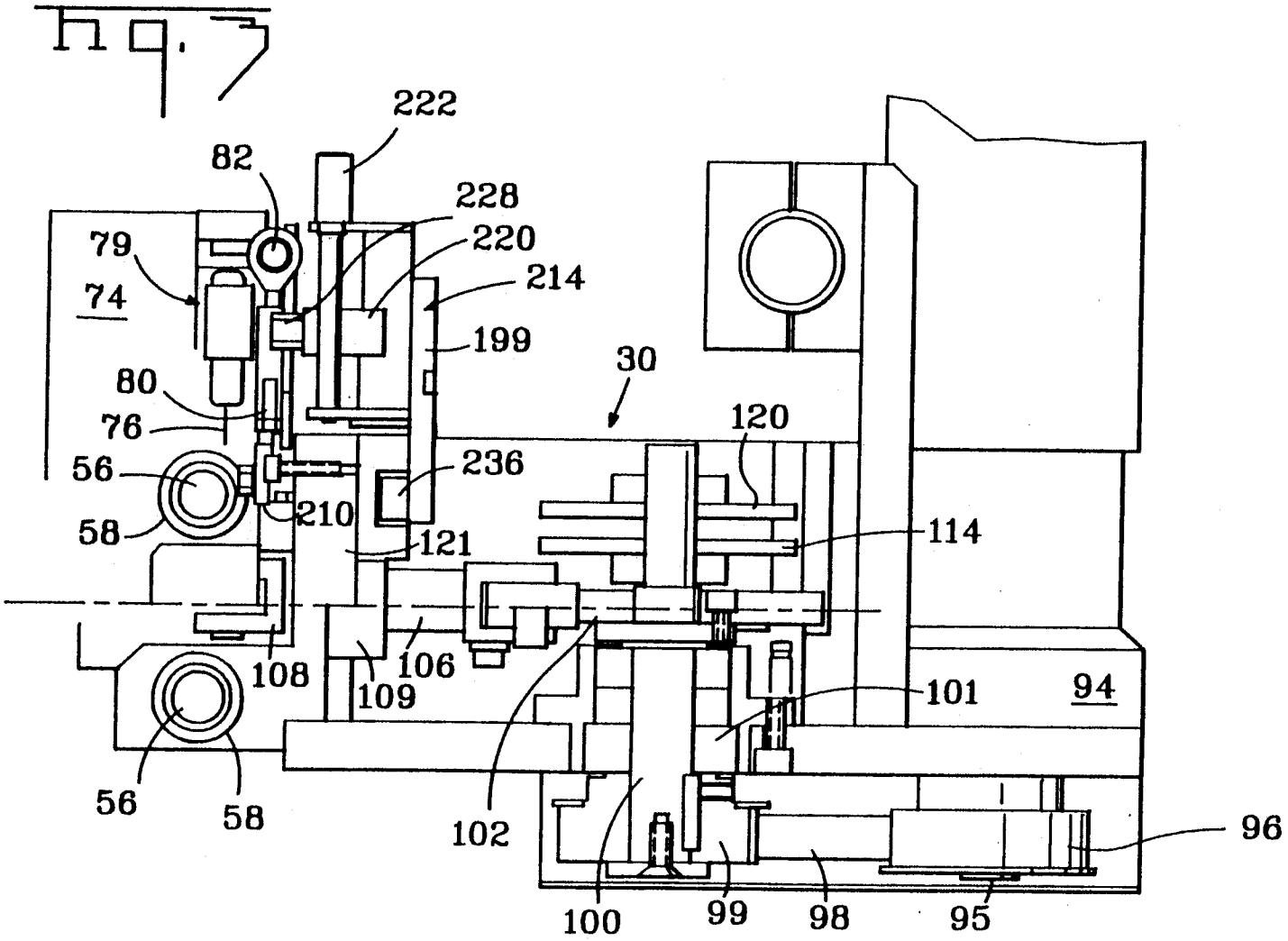
FIG. 7 is an enlarged vertical section of an anvil assembly of the apparatus.
Figure 6:
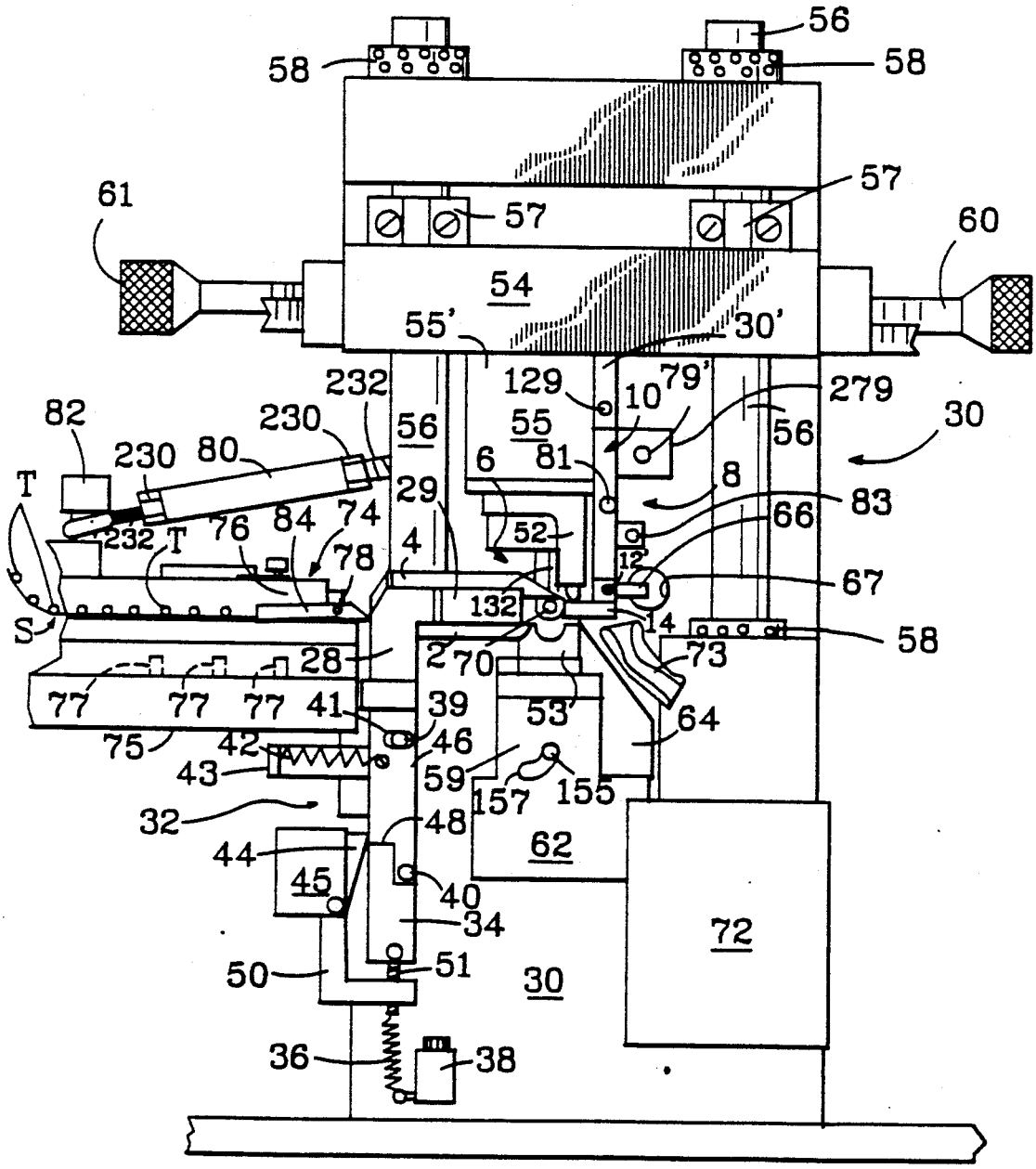
FIG. 6 is a diagrammatic front end view of the apparatus.
Figure 1:
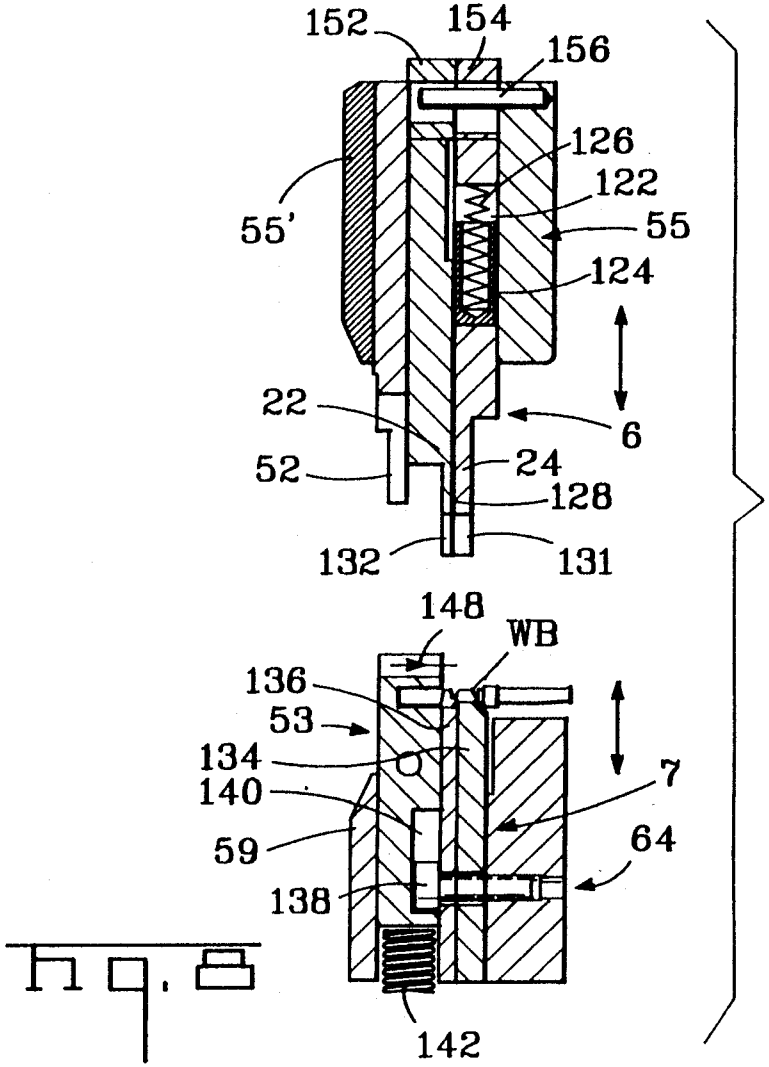
Figure 7:
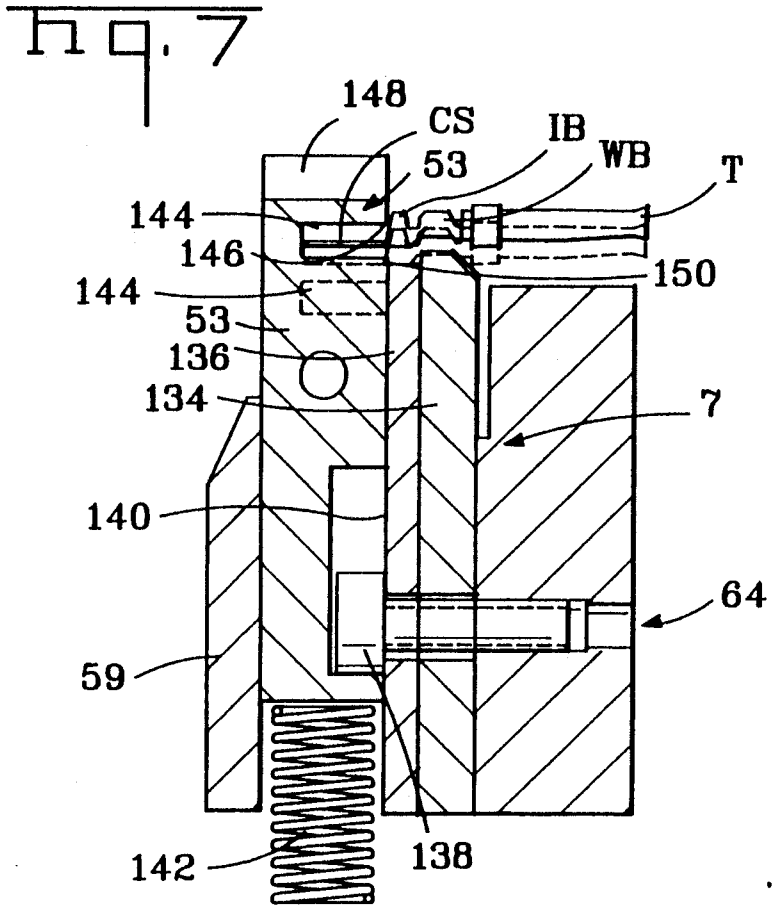

As shown in FIGS. 2, 6, and 7, the apparatus comprises a frame 30 to a forward part of which is a fixed wire gripper unit which is generally referenced 32 and which comprises the jaws 2 and 4. Jaw 2 is fixed to the front of the frame 30, the jaw 4 being vertically slidable with respect to the jaw 2, and having a shank 34 connected to the frame 30 by way of a tension spring 36 and a device 38 for adjusting the tension of that spring. The spring 36 normally urges the jaw 4 downwardly towards the jaw 2. The wire ejector 28 is pivoted to the shank 34 by means of a pivot pin 40 on the jaw 2. The ejector 28 is urged towards an anticlockwise (as seen in FIG. 6) retracted position by means of a return tension spring 42 on a bracket 43 on the jaw 2. In the initial position of the parts (FIG. 1A), the ejector 28 is positively secured in its retracted position in which a transverse ejection arm 29 of the ejector 28 is clear of the wire gripping surfaces of the jaws 2 and 4, by means of a spring loaded latch member 44 in a latch housing 45 and which engages a shank 46 of the ejector 28 in the open position of the jaws 2 and 4, that is to say in the raised position of the jaw 4. The throw of the ejector 28 is limited in both senses by a pin 39 on the shank 34, which is engaged in a horizontal slot 41 in the shank 46. When, as in FIGS. 1B and 1E, jaw 4 is in its lowered position, that is to say when the jaws 2 and 4 are closed, the tip of the latch member 44 lies below a shoulder 48 on shank 46. As the jaw 4 is raised in order to open jaws 2 and 4, the latch member 44 engages the shoulder 48 in the shank 46 and flips the ejector 28 across the jaws 2 and 4 to eject the wire W therefrom as shown in FIG. 1F. The ejector is then immediately returned to its retracted position by the spring 42, in which position the latch member 44 seats against the shank 46. The shank 34 of the jaw 4 is attached to an extension bracket 50 by means of a screw 51 for adjusting the vertical position of the jaw 4. The bracket is raised to open the jaws 2 and 4 by means of a mechanism which is described below.

The die set 6 has fixed thereto a tappet 52 for depressing a spring loaded shear block 53 in front of the anvil 7, for shearing out the slug SL when the terminal T of the strip S is being crimped to a wire W. The die set 6 is mounted by way of a crimper block 55 to an upper tool holder 54 which is mounted for vertical reciprocating movement on vertical columns 56 which are slidable in ball bearings 58 secured in the frame 30. The tool holder 54 is secured to the columns 56 by means of screw collars 57 and is provided with a wedge type adjustment means, described below, operated by means of calibrated hand screws 60 and 61, respectively, for adjusting the crimp height of the crimpers 24 and 22, respectively. The crimper block 55 has a front cover plate 55'.

Figures 14, 14A:
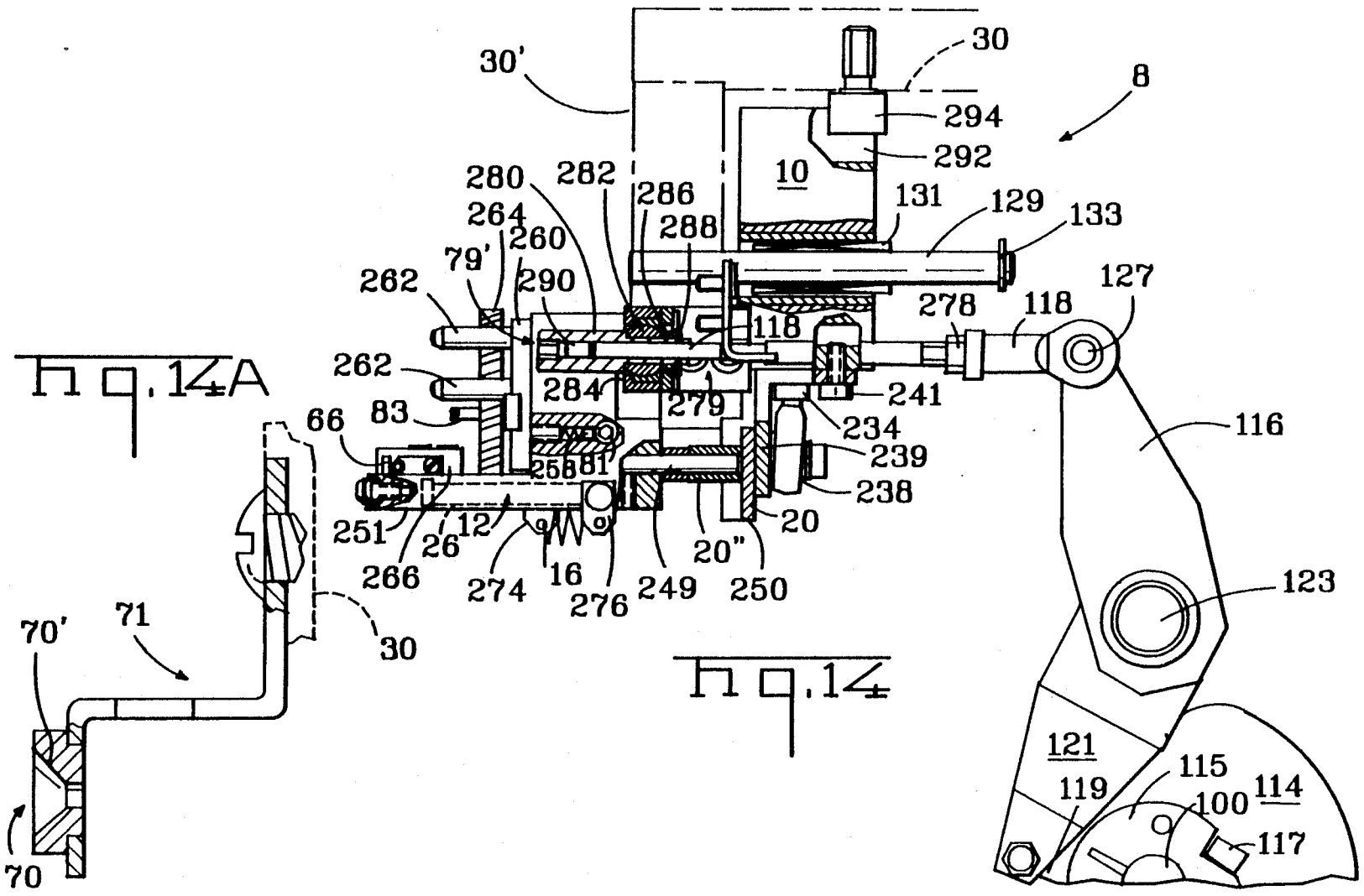
FIG. 14 is a side view of FIG. 13 shown mainly in section.
FIG. 14A is an enlarged top plan view, shown partly in section, of a wire guiding ring mounted on a bracket.

The anvil 7 is mounted in an anvil block 64 in a lower tool holder 62, being mounted in the frame 30 for vertical reciprocating movement The shear block 53 is vertically slidable between a front plate 59 of the tool holder 62, and the anvil 7. The support block 10 of the insulation stripper unit 8 is slidably mounted in the frame 30 for forward and rearward reciprocating movement above the anvil 7, the arms 12 and 12' of the unit 8 depending below the block 10. An insulation ejector (described below) of the unit 8 has an insulation ejector 66 projecting from the arm 12 and 12', for actuation by a cam 67 fixed to, and projecting forwardly from, the frame 30, as the block 10 is retracted, to eject the severed portion SP of insulation from between the arms 12 and 12', behind blades 14. A wire guiding ring 70 for guiding the end of the wire W between blades 14 is secured to the frame 30 so as to be aligned in front of the blades 14. As shown in FIG. 14A the ring 70 is screwed into an arm of an angle bracket 71 bolted to the frame 30, so as to be exchangeable to allow for the diameter of the wire to be used with the apparatus. The ring 70 has a flared wire guiding mouth 70' tapering towards the blades 14. Each severed portion SP of insulation falls from between the arms 14 into a waste box 72 at the front of the frame 30, being guided into the box 72 by means of a chute 73 on the frame 30. The box 72 also serves to receive terminal strip waste by way of the chute 73.

Figure 4:
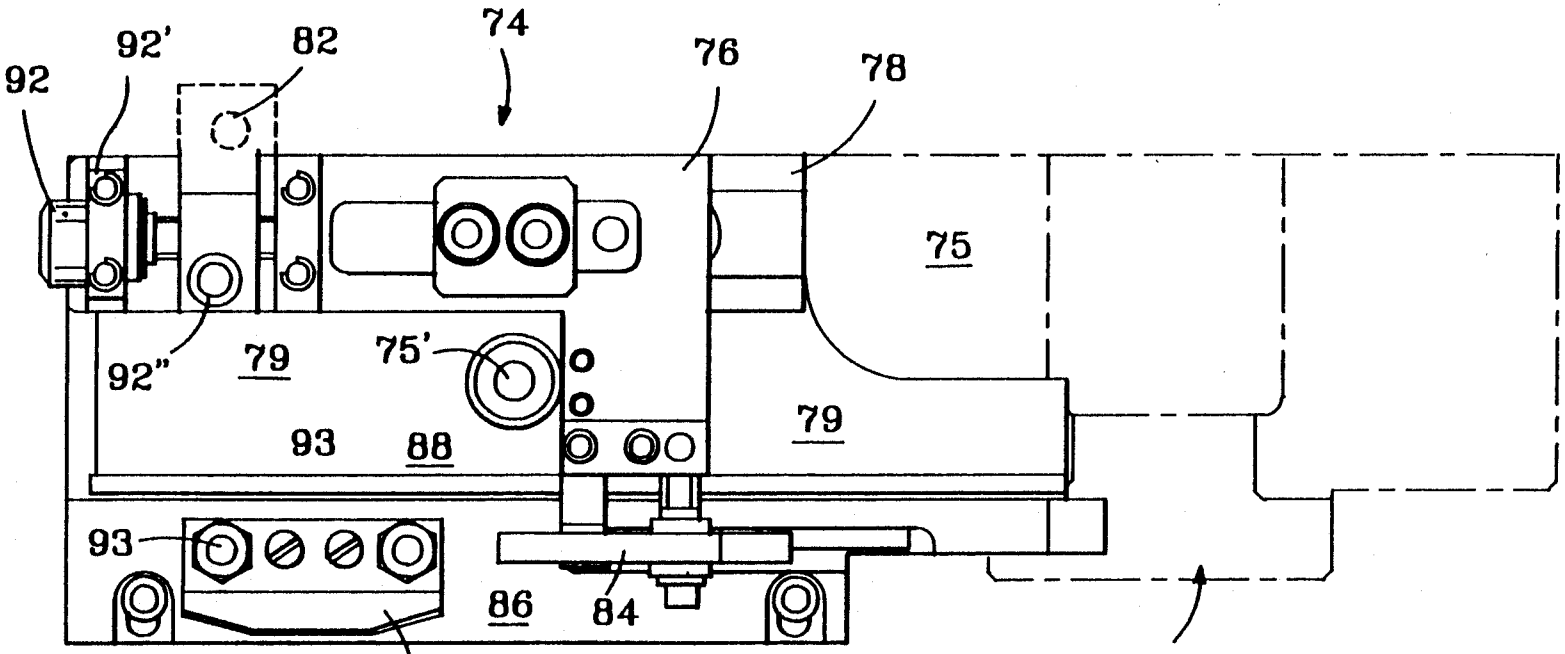
FIG. 4 is diagrammatic plan view of an electrical terminal feed unit of the apparatus.
Figure 5:
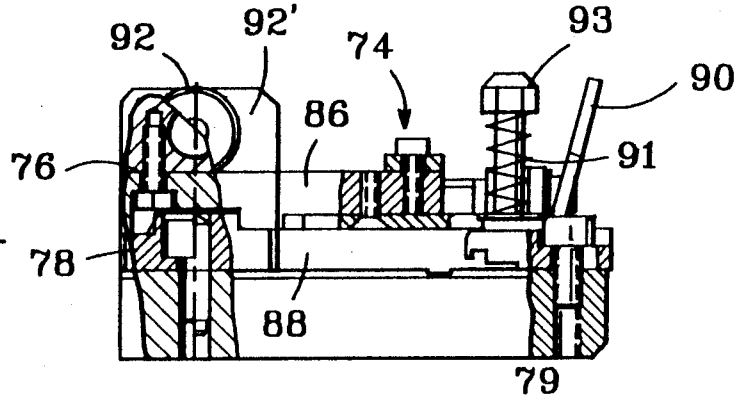
FIG. 5 is a cross sectional view of said unit.

As shown in FIGS. 4, 5 and 6, the terminal feed unit which is generally referenced 74 comprises a feed carriage 76 which is horizontally slidable along a rail 78 on a feed block 79 by means of a coupling rod 80 driven in reciprocating movements by means described below. The rod 80 is attached to an upright fixture 82 on the carriage 76. On the carriage 76 is a feed finger 84 engaging the strip S of terminals T to drive the strip S horizontally between guide plates 86 and 88, towards the anvil 7. Abrupt movement of the strip S which would result in overfeed thereof is prevented by a drag plate 90 loaded by springs 91 on bolts 93 on the carriage 76. The feed length of the strip S can be adjusted by means of an adjusting screw 92 in a bracket 92' on the block 79, for adjusting the position of the feed finger 84, which position can be fixed by means of a set screw 92''. The feed block 79 is fixed to a side plate 75 of the lower tool holder 62 by means of a bolt 75' and is centered with respect to the plate 75 by means of centering pins 77 (FIG. 6).

The horizontal position of adjustment of the stripper unit 8, which determines the position of the wire W in relation to the leading terminal T at the time of the stripping and crimping operations is adjustable by means of a set screw 79'. The position of the sensor 26 in relation to the blades 14 is adjustable by means of a set screw 83 to determine the stripped length of the wire W, and the depth to which the blades 14 cut into the insulation of the wire W is adjustable by means of a stop screw 81 (FIGS. 13, 16 and 17) on the arm 12'.

Figure 2A:
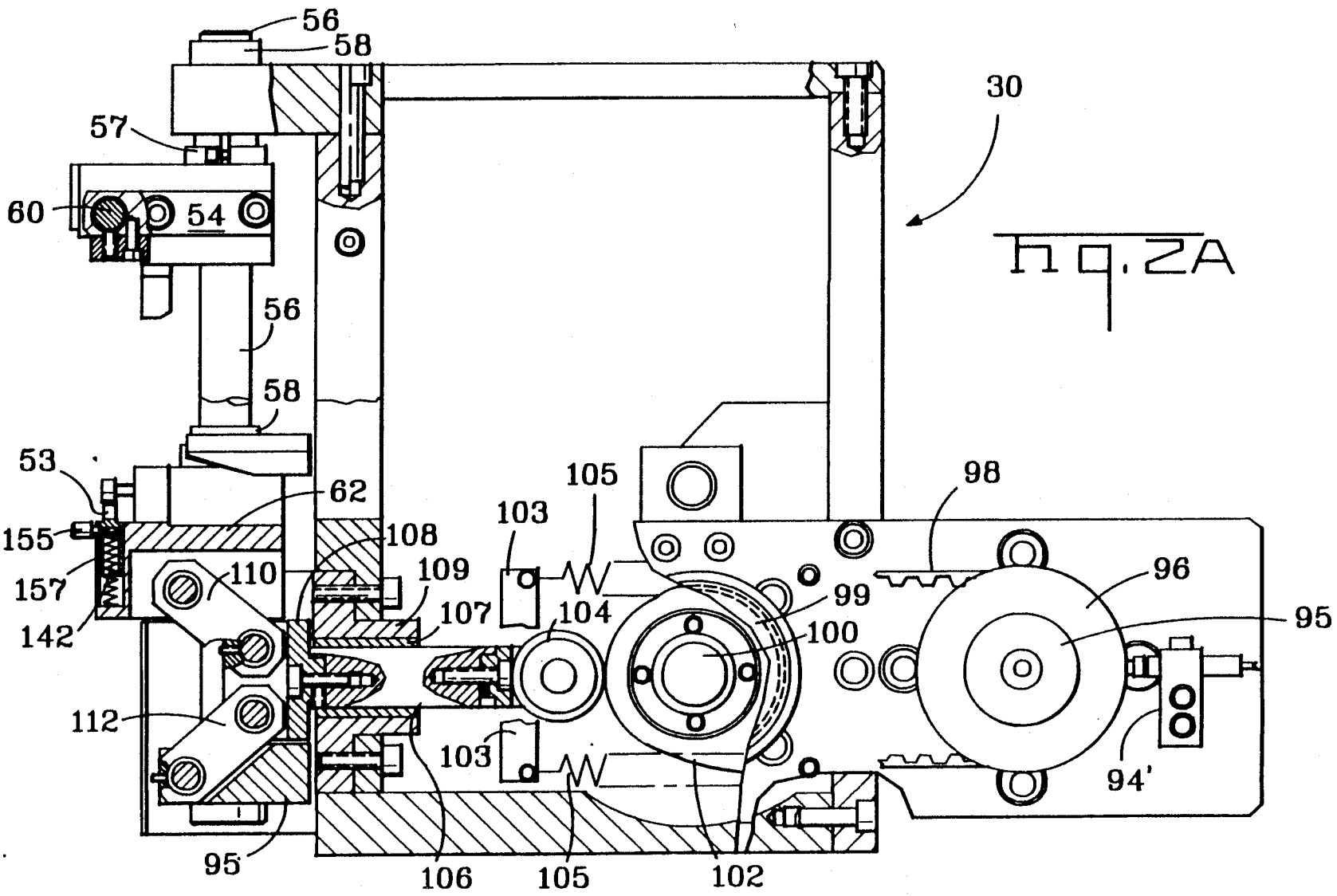
FIG. 2A is a diagrammatic side view of the apparatus shown partly in section and with parts omitted.

The units described above are all driven by means of an electronically controlled direct current motor 94 (FIGS. 2, 2A and 3) supplied with power by way of a connector 94' and having a shaft 95, to which is fixed a drive wheel 96 connected by a toothed belt 98 to a driven roll 99 keyed to a cam shaft 100 mounted in bearings 101 in the frame 30 rearwardly of the wire stripper unit 8. The cam shaft 100 has keyed thereto a first disc cam 102 engaging a cam follower roller 104 on a slide rod 106 slidable in bearings 107 in a bearing block 109 on the frame 30 and having a head 108 on which are pivoted toggle links 110 and 112. The rod 106 has arms 103 connected to springs 105 on the frame 30 and which urge the cam follower 104 against the cam 102, (FIG. 1A). Thus, as the cam 102 is rotated by the motor 94 from the angular position in which the cam 102 is shown in FIGS. 2 and 2A, the slide rod 106 is moved leftwardly as seen in those FIGS. so that the lower tool holder 62 is raised, and the upper tool holder 54 is lowered whereby the diet set 6 and the anvil 7 are driven to their FIG. 1D positions from their positions of FIGS. 1A to 1C, the die set 6 and the anvil 7 being returned to their starting positions when the cam 102 has turned full cycle.

A second disc cam 114 keyed to the shaft 100 by way of a split hub 115 and a screw 117 acts upon a cam roller 119 on the lower end (as seen in FIGS. 13 and 14) of an arm 121, the upper end of which is secured to a hub 123 journaled in a bearing block 125 (FIG. 2) on the frame 30. The lower end of a further arm 116 is fixed to the hub 123, the upper end of the arm 116 being pivotally connected by way of a bearing 127 to one end of a coupling rod 118, the other end of which is connected to the stripper unit 8, which is slidable forwardly and rearwardly of the frame 30 on a rod 129 extending through bearings 131 in the stripper block 10, and being fixed at its left hand end (as seen in FIG. 14), in a depending portion 30' of the frame 30, the other end of the rod 129 having a stop collar 133 for the block 10. The cam 114 is so contoured that during the position of the parts shown in FIGS. 1A and 1B, the unit 8 dwells in its advanced position, is then retracted to its FIG. 1C to F position, dwells in its retracted position until the jaws 2 and 4 have opened and the anvil 7 has been lowered, and is then advanced again to its FIGS. 1A and 1B position, by means of a tension spring 133' (FIG. 15) connected at one end to a rod 135 passed through the bearing 127 and at its other end to a stub 137' on a bracket 137 projecting laterally from the unit 8.

A third cam 120 keyed to the shaft 100 by means of a split hub 120' and screw 120" acts upon a feed lever 121' which is connected, indirectly as described below, to the coupling rod 80, the can 120 being contoured to cause the feed finger 84 to be retracted by the pitch of the terminals T as the jaws 2 and 4 are closed, and to cause the feed finger 84 to be advanced when the jaws 2 and 4 are closed, and to cause the feed finger 84 to be advanced when the jaws 2 and 4 have opened (FIG. 1F), to feed a further terminal T' onto the anvil 7. The feed lever 121' is connected by a linkage, described below, to the extension plate 50 to cause the jaws 2 and 4 to be opened as the die set 6 rises and the anvil 7 falls (FIG. 1F). The wedge lever 20 is indirectly connected to the extension bracket 50 (as described below) to open the blades 14 when the jaws 2 and 4 are opened and close the blades 14 when the jaws 2 and 4 are closed, as described in detail below.

Figure 8A:
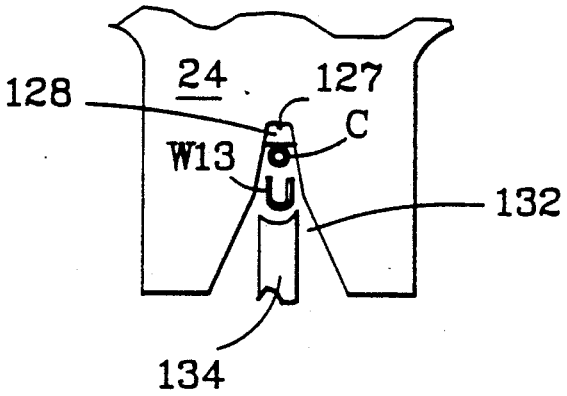
FIG. 8A is a fragmentary elevational view of part of the crimping die assembly illustrating the operation of a wire positioner thereof.
Figure 9:
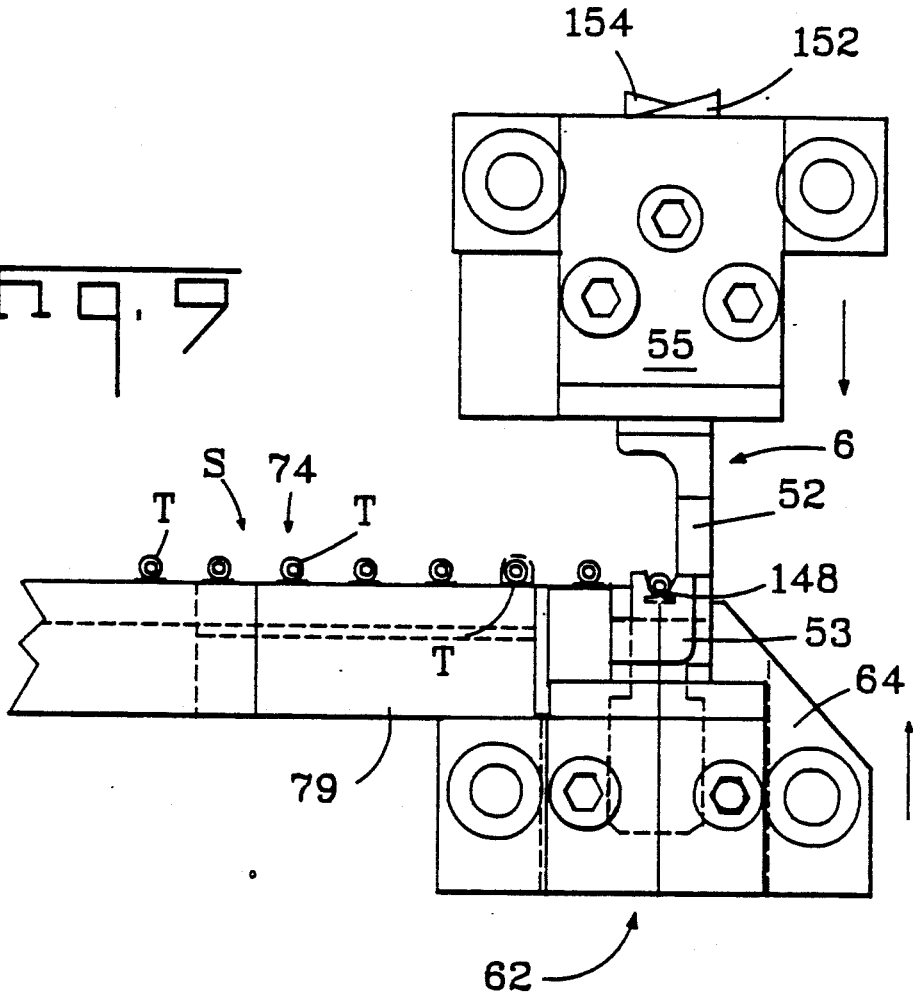
FIG. 9 is a diagrammatic side view of the die and anvil assemblies also showing a terminal feed assembly.

The die set 6 and anvil 7 will now be further described with reference to FIGS. 7 to 9. The anvil 7 comprises a first part 134 for cooperation with the crimper 24 to crimp the wire barrel WB and a second part 136 for cooperation with the crimper 22, to crimp the insulation barrel IB of the terminal T. As shown in FIG. 8 the wire crimper 24 has a recess 122 within the block 55 in which is slidably mounted a wire positioner 124 urged downwardly by means of a compression spring 126 and having a wire positioning projection 128 extending between the crimpers 22 and 24 and crimping recesses 130 and 132 thereof for ensuring that the wire core C is held away from the ferrule forming base 127 of the crimping recess 132 during the crimping operation, by the projection 128, as shown in FIG. 8A, so that the base 127 curls the arms of the U-shaped wire barrel WB smoothly about the wire core C, in cooperation with the anvil part 134, the projection 128 being driven upwardly against the action of the spring 126, to allow this.

The shear block 53 is vertically slidable within limits determined by a screw head 138 which engages in a vertical recess 140 in the block 53 as shown in FIGS. 7 and 8, the block 53 being urged upwardly by compression spring 142. In its upper end portion the block 53 is formed with a horizontal recess 144 defining an upper shear edge 146, and through which is fed the carrier strip CS by which the terminals T of the strip S are interconnected. The block 53 is surmounted by a wire channel 148 for receiving the wire W as the die set 6 and the anvil 7 are closed thereabout. When, as shown in FIG. 9, the tapet 52 engages the block 53 on one side of the channel 148, the block 53 is forced down, to its broken line position in FIG. 9, against the action of the spring 142 so that the upper shear edge 146 cooperates with an adjacent lower shear edge 150 of the anvil part 136 to shear the leading terminal T from the carrier strip CS.

Above the crimpers 22 and 24 in the crimper block 55 are wedge members 152 and 154, respectively, which are loosely retained by a rod 156 and which are displaceable by means of wedge members (not shown) on the adjustment screws 61 and 60, respectively, to adjust the crimp height of the crimpers 22 and 24, respectively, independently of each other. In order to allow the anvil 7 to be exchanged, a bolt 155 (FIGS. 2A and 6) in the block 53 engages in an L-shaped slot 157 in the plate 59 so that the block 53 can be locked in a lowered position against the action of the spring 142.

Figure 10:
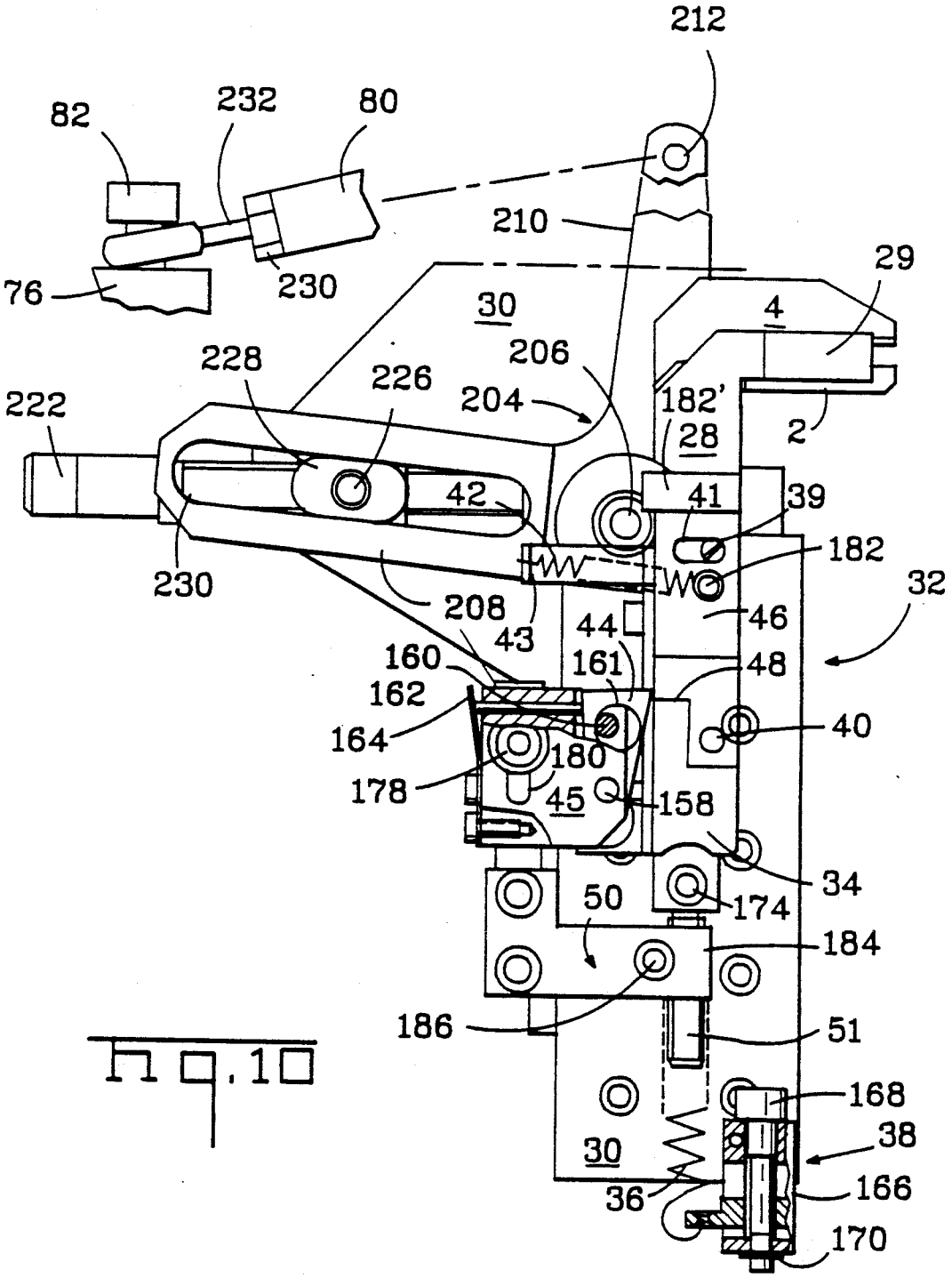
FIG. 10 is an enlarged front view shown partly in section of a wire gripper unit of the apparatus, and part of its operating mechanism, and part of a mechanism for operating a terminal strip feed carriage of the apparatus.
Figure 11:
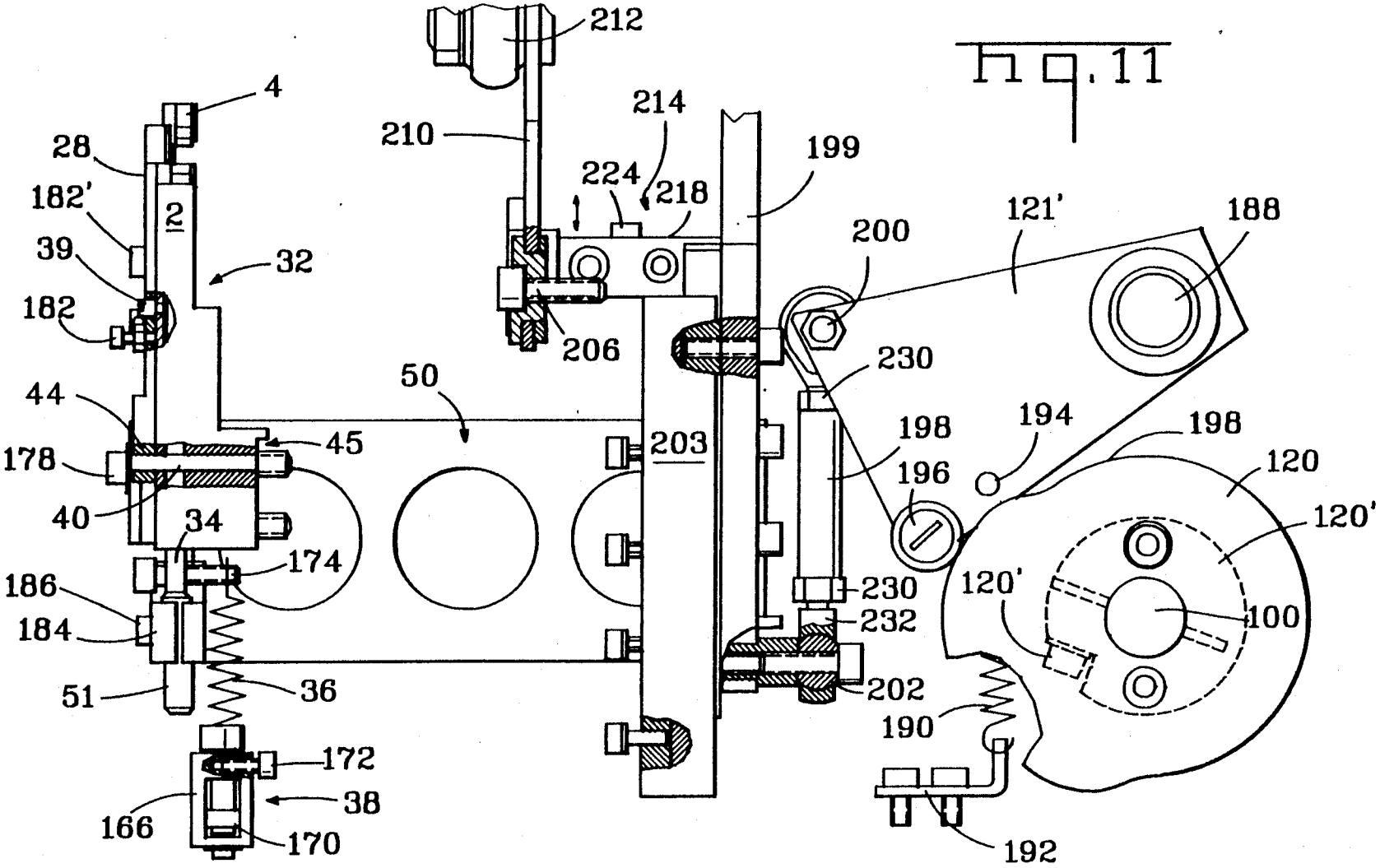
FIG. 11 is a side view of FIG. 10 shown partly in section.

The wire gripper unit 32 will now be further described with reference to FIGS. 10 to 12. As shown in FIG. 10, the latch member 44 is mounted on a pivot pin 158 in the latch housing 45 and is urged against the shank 46 of the ejector 28, to an extent limited by a stop pin 160 in the housing 45, by a leaf spring 162 by way of a slide pin 164 in the housing 45, the pin 160 extending through a circular hole 161 in the member 44. The adjustment device 38 comprises a frame 166 in which is an adjustment screw 168 which is rotatable to adjust the vertical position of a slide 170 in the frame 166, to which slide the tension spring 36 is attached. The screw 168 is securable in its position of adjustment by means of a set screw 172 (FIG. 11). The spring 36 is connected to a bolt 174 on the shank 34 of the jaw 4. The housing 45 is mounted on the extension bracket 50, for vertical adjustment by means of a screw 178 on the bracket 50 engaging in a slot 180 in the housing 45. The tension spring 42 is connected to the ejector 28 by means of a screw 182 just below the slot 41. The ejector is guided by means of a bracket 182' on the jaw 4. The bracket 50 extends rearwardly about the frame 30, the screw 51 connecting the shank 46 of the jaw 4 to the bracket 50 meshing with a nut 184 formed in the bracket 50, to allow of adjusting the vertical position of the jaw 4, a set screw 186 being provided for retaining the screw 51 in its required position of adjustment. The feed lever 121' is urged in an anticlockwise sense (as seen in FIG. 11) about its bearing 188 on the frame 30, by means of a spring 190 secured to a bracket 192 on the frame 30 and to pin 194 on the lever 121. A roller 196 on the lever 121 is thereby urged against the cam surface 198 of the cam 120. The roller 196 is located at one corner of the lever 121, which is remote from the bearing 188, the opposite corner of the lever 121, which is also remote from the bearing 188 being connected to one end of a coupling rod 198 by means of a pivot pin 200. The other end of the rod 198 is pivotally connected by way of a bearing 202, to a wedge lever drive plate 199 which is in turn fixed to an adjustment assembly mounting plate 203 secured to the extension bracket 50.

The feed finger 84 is retracted and advanced, through the agency of a bell crank lever 204 pivoted to the frame 30 on a bearing 206 and having a lateral arm 108, and an upstanding arm 210. One end of the coupling road 80, the other end of which is connected to the feed carriage 76 by way of the fixture 83, is pivotally connected to the free end of the arm 210 by way of a bearing 212 as indicated schematically in FIG. 10. The extension bracket 50 is connected to a finger stroke length adjustment assembly 214 on the plate 203 (FIG. 12), and which is vertically movable with respect to the frame 30, with the bracket 50, to cause the bell crank 204 to swing in a clockwise sense (as seen in FIG. 10) to advance the feed carriage 76 as the bracket 50 is raised, and in the opposite sense to retract the feed carriage 76 as the bracket 50 is lowered.

Figure 12:
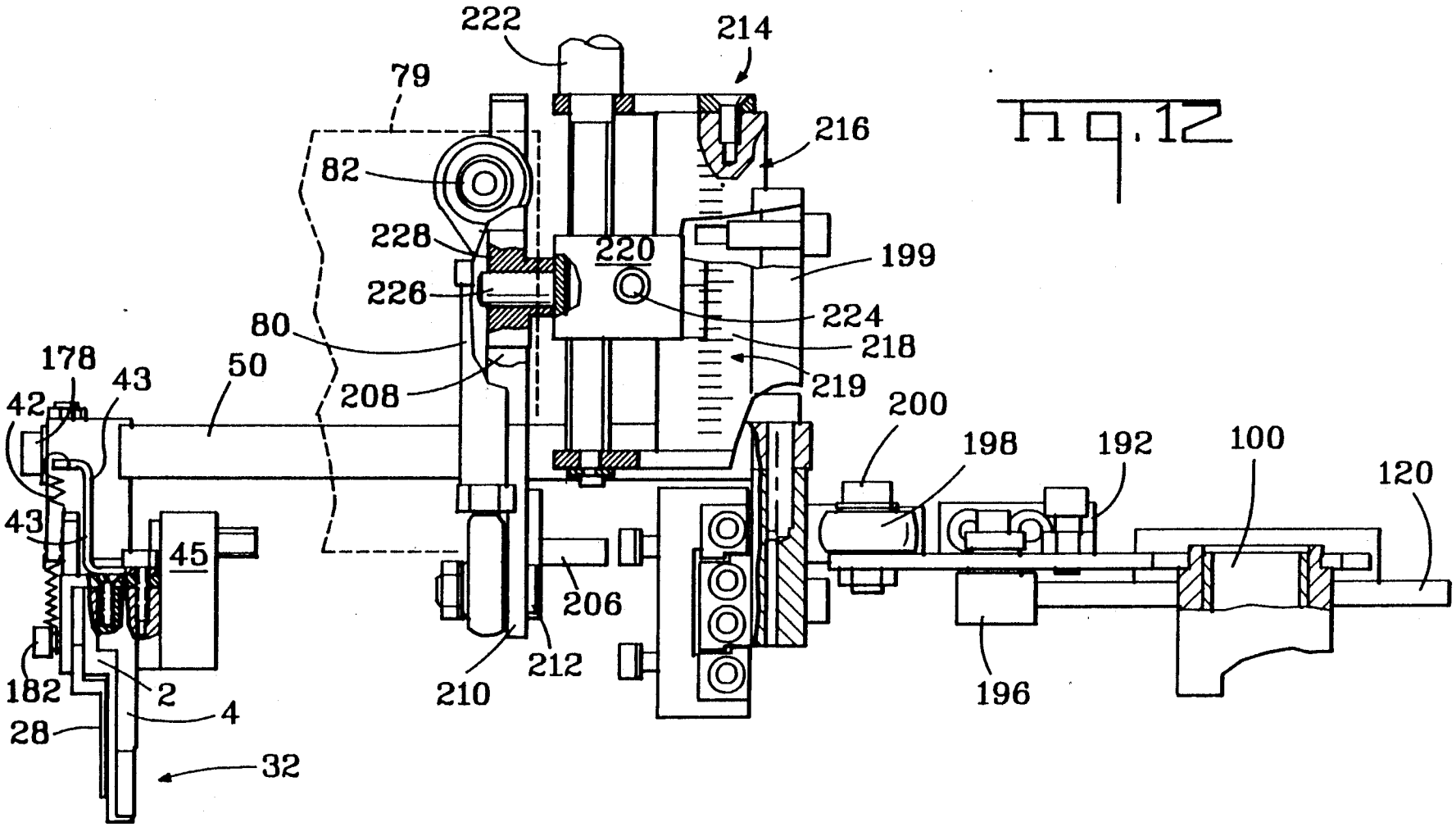
FIG. 12 is a top plan view of FIG. 10, shown partly in section.

As best seen in FIG. 12, the assembly 214 comprises a framework 216 having on an upper frame plate 218 thereof a calibrated scale 219 which is positioned rearwardly of feed block 79. An adjustment slide 220 is mounted on an adjusting screw 222 in the framework 216, which can be rotated by the operator to move the slide 220 along the scale 219 on the plate 218. The slide 220 has a set screw 224 for locking it in a selected position along the scale 219. There projects forwardly from the slide 220 a spigot 226 which is engaged in a further slide 228 which as best seen in FIG. 10, is slidable along a longitudinal slot 230 in the arm 208 of the bell crank 204. The position of adjustment of the slide 220 thus determines the throw of the arm 210 of the bell crank 204 and, therefore, the stroke length of the feed carriage 76 and of the feed finger 84. The adjustment of the slide 220 must be such that the feed finger 84 always engages in one of a series of detent holes (not shown) in the carrier strap CS when the finger 84 is in its retracted end position, so that the strip S of terminals T is driven forward as the finger 84 is advanced. As the bracket 50 is lowered, the jaw 4 is driven down positively by the spring 36 so that the wire W inserted between the jaws 2 and 4 is positively gripped therebetween. The lengths of the coupling rods 80 and 198 are adjustable by means of nut and screw thread, means 230 and 232, respectively, thereon, as shown.

Figure 17:
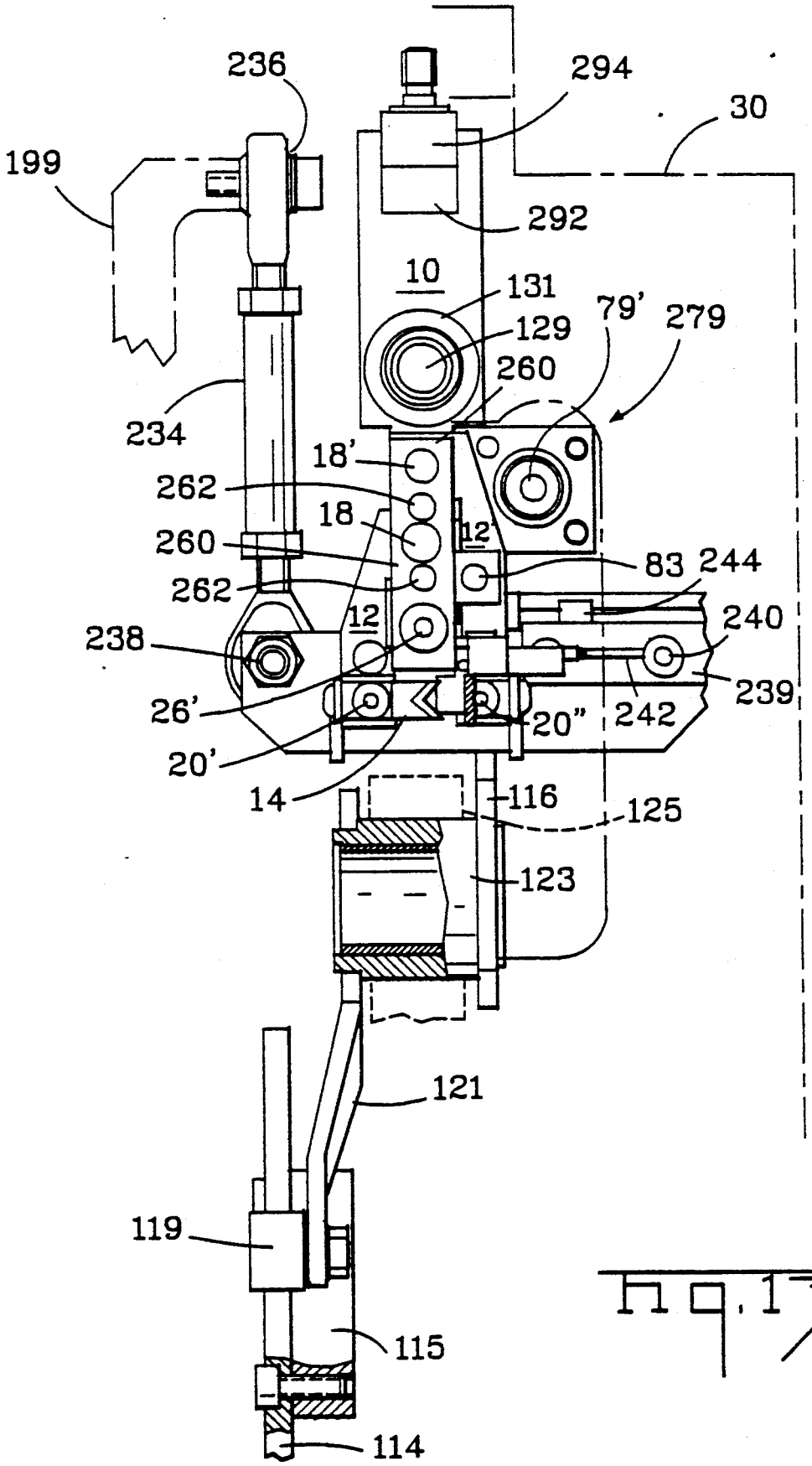
FIGS. 16 and 17 are enlarged diagrammatic front views illustrating parts of the stripper unit in two respective positions thereof.
Figure 16:
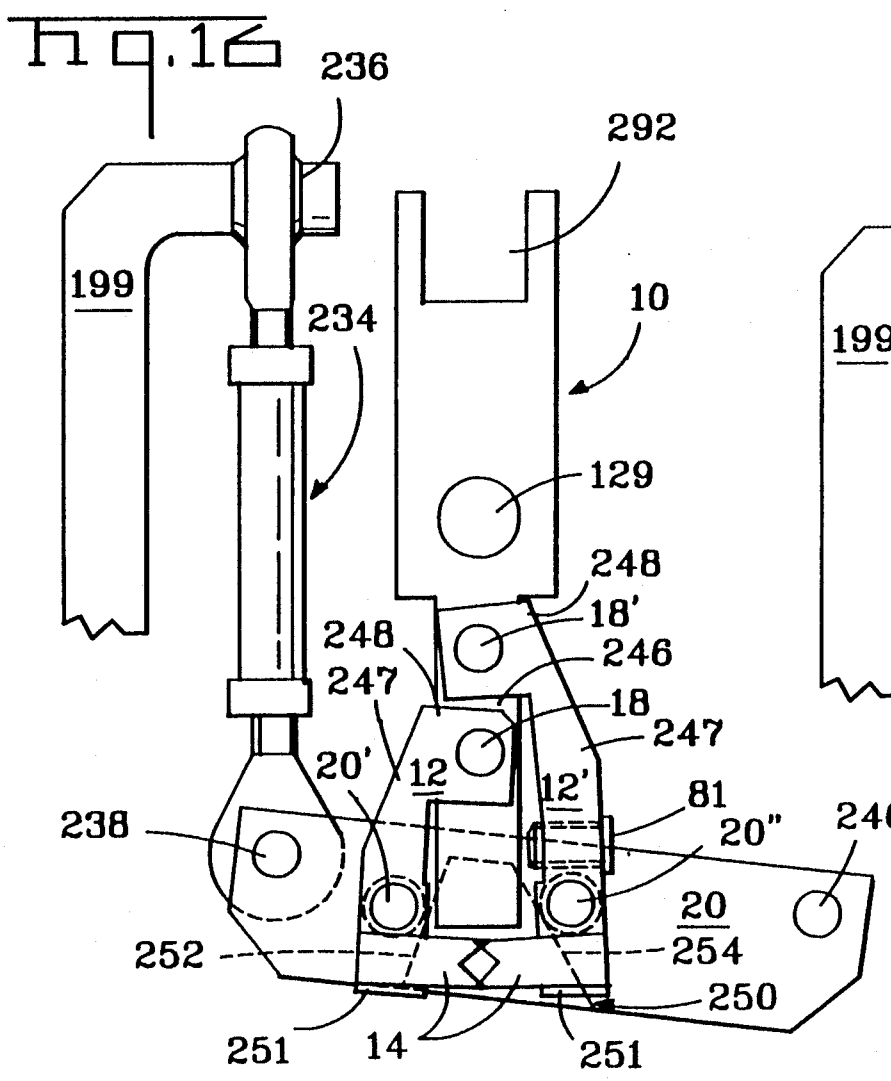

The stripper unit will now be further described with particular reference to FIGS. 13, 16 and 17, the wedge lever drive plate 199 is connected at its upper end of a coupling rod 234 of adjustable length, by way of a bearing 236, the lower end of the rod 234 being pivotally connected by way of bearing 238, to one end of the wedge lever 20, the other end of which is pivoted on a pivot pin 240, to an angle plate 239 fixed to the block 10 by means of a screw 241 (FIG. 14).

Figure 18:
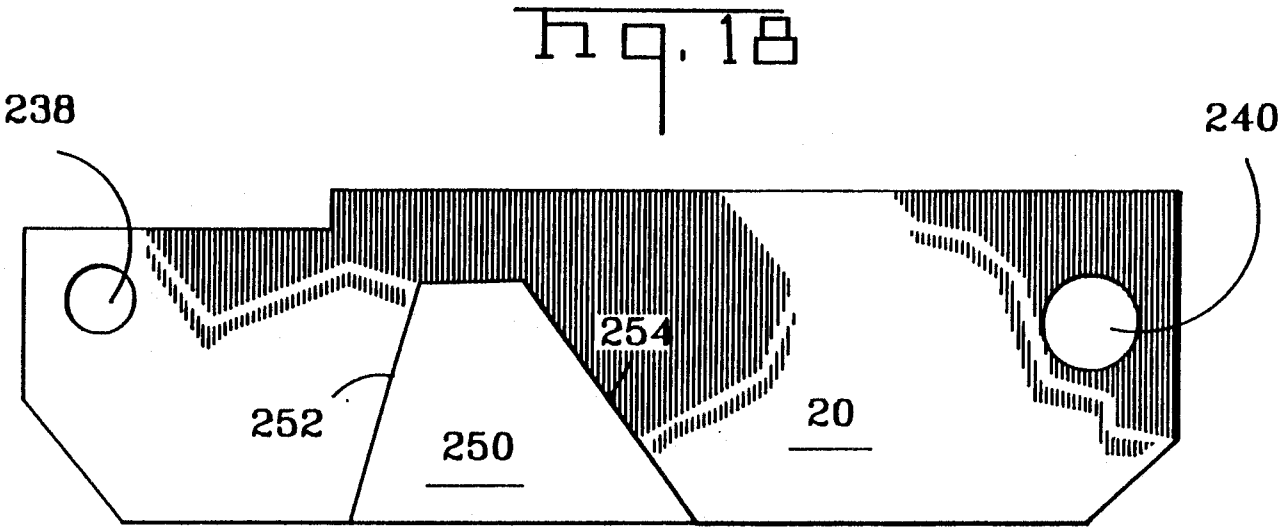
FIG. 18 is an enlarged front view of a wedge lever of the stripper unit.
Figure 19:
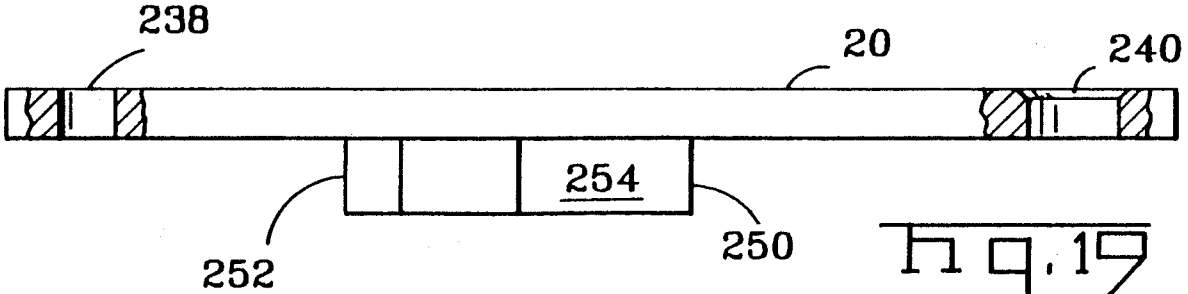
FIG. 19 is a top plan view of FIG. 18.

The pivot pin 240 is adjustable lengthwise of a slot 242 in the plate 239 and can be fixed in its position of adjustment by means of a lock screw 244. As best seen in FIGS. 16 and 7 each of the arms 12 and 12' is connected by its respective pivot pin 18 or 18', to a depending extension 246 of the block 10, by way of a flange 248 from which a vertical part 247 of the arm extends at right angles, the rollers 20' and 20'' projecting from their respective arms on bearing rods 249, proximate to, but back from horizontal parts 251 of the arms, which carry the blades 14. The vertical part 247 of the arm 12 is taller than that of the arm 12 as best seen in FIGS. 16 and 17 and is pivoted there above. As best seen in FIGS. 18 and 19, the wedge lever 20 has projecting forwardly thereof and between the roller 20' and 20'', a wedge block 250 having a first cam surface 252 for the roller 20', angled by 13 degrees with respect to the central vertical plane of the block 250, and a second cam surface 254 angled by 35 degrees with respect to said plane, for the roller 20'' the surfaces 252 and 254 being so angled in order to compensate for the difference in the effective length of the lever 20 at the respective rollers 20' and 20''. When, as the cam 120 rotates, the rod 198 is raised to raise the jaw 4 (FIG. 1F), the drive plate 199 is also raised so that as shown in FIG. 16, the wedge block 250, is forced up between the rollers 20' and 20'' whereby the cam surfaces 252 and 254 act on the rollers 20' and 20'', respectively to force the arms 12 and 12', and thus the blades 14, apart from each other against the action of the spring 16, to assume their open position. When the rod 198 is lowered by the action of the cam 120 to lower the jaw 4 (FIG. 1B) the plate 199 and thus the rod 234 are lowered as shown in FIG. 17, so that the wedge block 250 is retracted to allow the blades 14 to close about the wire W under the action of the spring 16.

The stop screw 81 which engages the extension 246 in the closed position of the blades 14 (FIG. 17) is adjustable to allow the spacing between the arm 12' and the extension 246 to be adjusted thereby to adjust the insulation cutting depth of the blades 14 in their closed position. As shown in FIG. 14, the screw 81 is retained in its position of adjustment by means of a spring loaded retainer 258.

Figure 15:
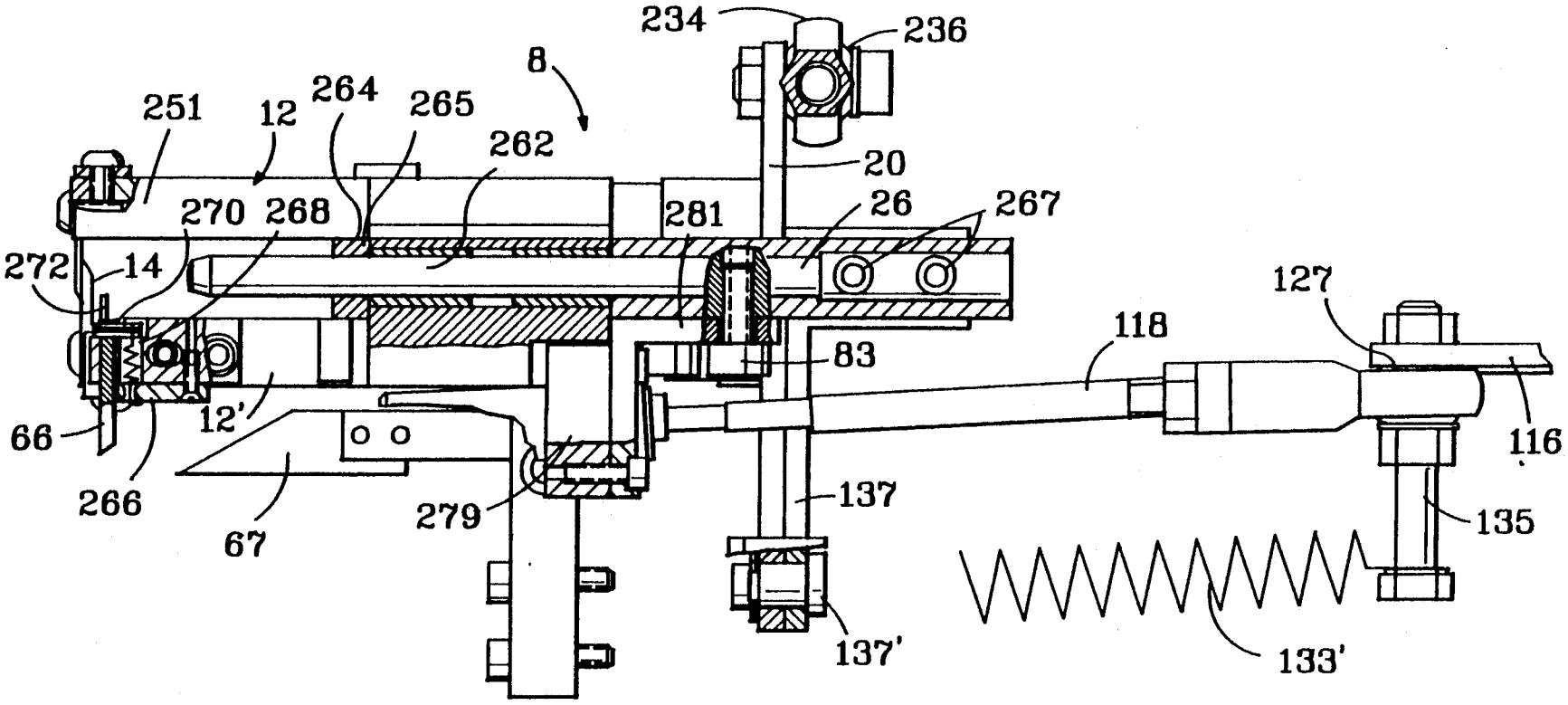
FIG. 15 is a top plan view of FIG. 14 shown partly in section.
Figure 17:
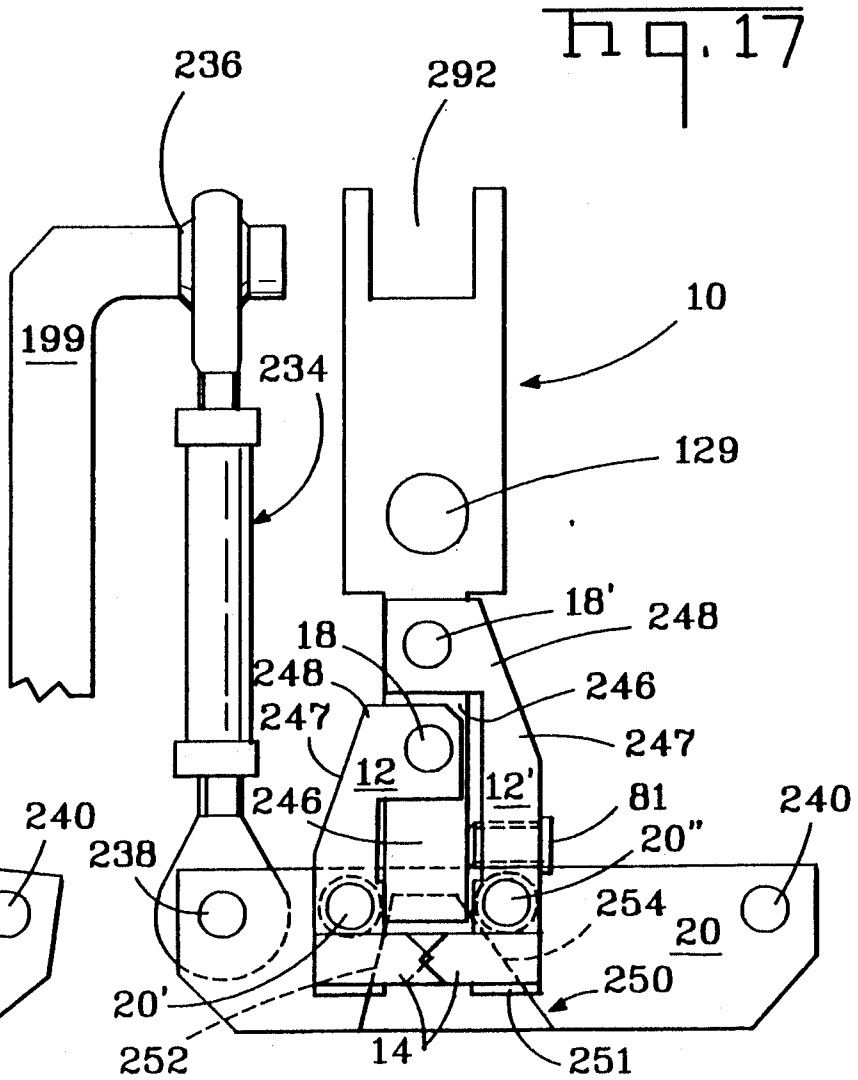

The flanges 248 and the vertical parts 247 of the arms 12 and 12' are covered by a face plate 260, as best seen in FIGS. 13 and 14, secured to the extension 246 by fastener means 261 and beneath which the horizontal parts 251 of the arm project forwardly. On the face plate 260 are forwardly projecting rods 262 which guide a spring loaded sensor adjustment plate 264, which is shown in FIG. 14, and to the lower end of which the sensor 26 is secured in a sensor holder 265. The sensor has terminals 267 connected to a drive circuit of the motor 94 (FIG. 15). The plate 264 can be moved towards and away from the plate 260 by rotating the screw 83 to adjust the horizontal position of the sensor 26 with respect to the blades 14.

As best seen in FIG. 15, the insulation ejector 66 is slidable in a housing 266 on the horizontal part 251 of the arm 12' proximate to its blade 14, against the action of a tension spring 268 connected to a stop collar 270 on the ejector 66 and to the housing 266. As the insulation stripping unit 8 is retracted (FIG. 1C), and the ejector 66 is driven against the cam 67 an ejector nose 272 on the ejector 66 is moved across the blades 14 to eject the severed position SP of insulation.

As shown in FIG. 14, the spring 16 is secured to lugs 274 and 276 on the parts 251 of the arms 12 and 12', respectively, the lugs 274 and 276 being offset from each other lengthwise of the parts 251, so that as the blades 14 are closed about the wire W (FIG. 1B), the blades 14 are urged against each other.

The coupling rod 118, which is of adjustable actual length by virtue of a screw thread and nut arrangement 278, is connected in a joint housing 279 projecting laterally from the extension 246 on a bracket 281 (FIG. 15), to a ball and socket joint comprising the set screw 79' which is in the form of a sleeve 280 threadedly receiving the rod 118 and extending through a ball 282, as shown in FIG. 14, in a ball housing 284. The sleeve 280 is secured in the ball 282 by means of a nut 286 and a lock washer 288. Within the sleeve 280 is a lock screw 290. In order to adjust the horizontal position of the stripper unit 8 to determine the position of the wire W in relation to the terminal T, the lock screw 290 is first loosened, the set screw 79' is rotated in a clockwise sense to advance the unit 8 or in an anticlockwise sense to retract it, and the lock screw 290 is then tightened. The ball and socket joint compensates for the angular movement of the rod 118.

The block 10 is formed at its upper end with a central groove 292 which receives a guide roller 294 depending from the top of the frame 30, as shown in FIGS. 13 and 14, to prevent the stripper unit 8 from tilting about the rod 129.

Wire gripper jaws and their operating means according to the second embodiment of the invention will now be described with reference to FIGS. 20 to 23, in which parts having a similar function to those described above bear the same reference numerals but with the addition of the suffix letter x.

Figures 20, 21, 22:
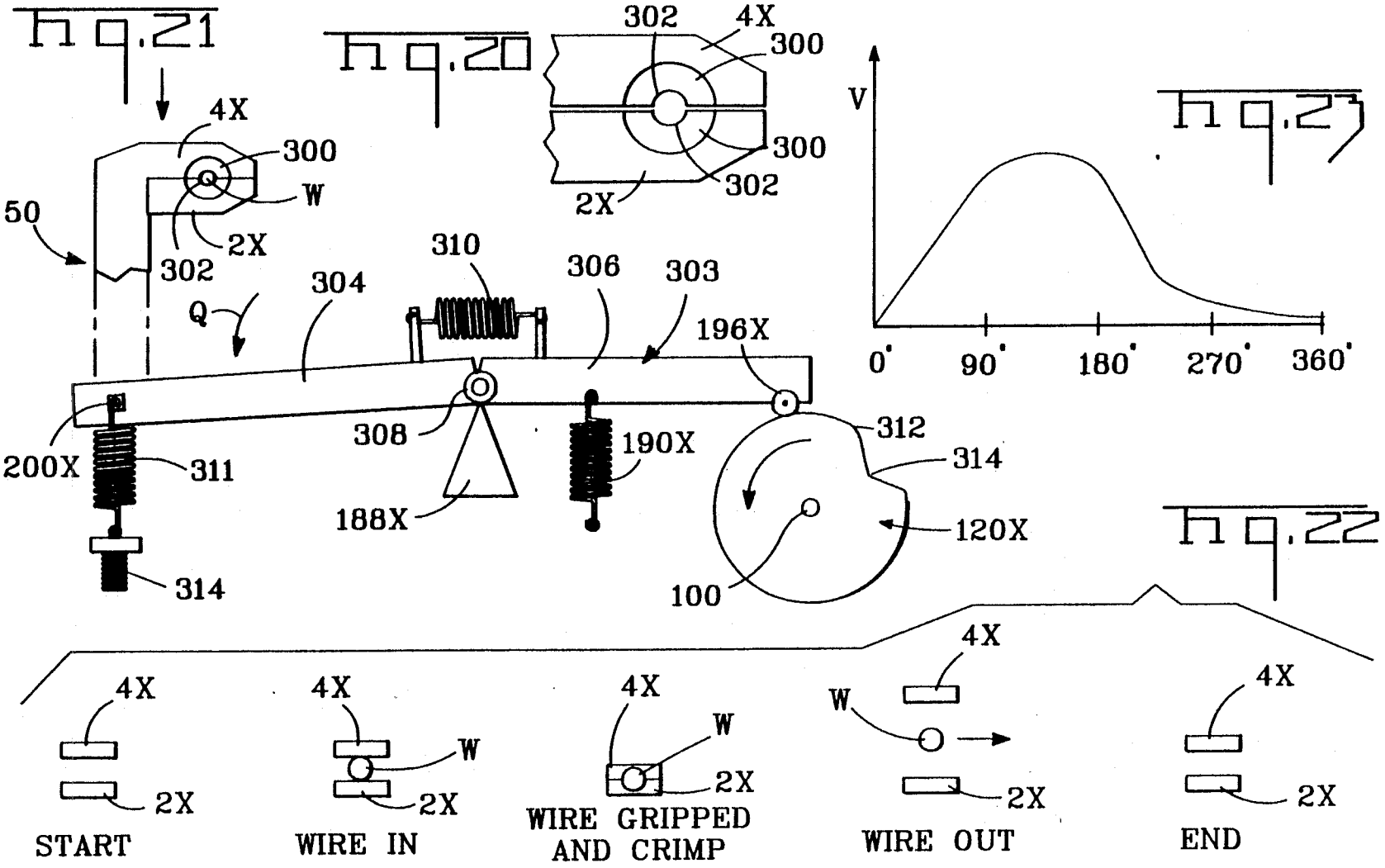
FIG. 20 is a fragmentary side view of wire gripper jaws of apparatus according to a second embodiment of the invention.
FIG. 21 is a diagrammatic side view of the mechanism for operating the jaws of FIG. 20.
FIG. 22 is a diagram illustrating the operation of the jaws of FIG. 20.

As shown in FIG. 20, the jaws 2x and 4x of the wire stripper unit 8x are formed with semi-circular, rearwardly convergent wire guide mouth halves 300 each defining a semi-circular, central wire receiving opening 302. As illustrated by the diagram of FIG. 21, the jaw 4x is operated by means of a rotary disc cam 120x on the shaft 100, engaging a roller 196x on one end of a resiliently unidirectionally flexible lever 303 pivoted about a fulcrum 188x. The other end of the lever 303 is pivotally connected at 200x to the jaw 4x, for example by way of the bracket 50 to allow slight vertical play between the lever 303 and the jaw 4x, as indicated diagrammatically in FIG. 21. The lever 303 comprises two halves 304 and 306 respectively, connected by means of a pivot 308, the part 304 of the lever 303 being arranged to flex in the direction of the arrow Q in FIG. 21, but not in the opposite direction, from a position of alignment with the part 306 about the pivot 308 and against the action of a return spring 310. The roller 196x is urged against the cam 120x by means of a very weak tension spring 311.

The operation of the wire stripper 8x will now be described with particular reference to FIGS. 22 and 23. In the start, or wire receiving position of the apparatus, the cam 120x is not under power, as indicated at 0° in FIG. 23 in which the ordinate indicates the velocity V of the electronically controlled motor 94 and the abscissa indicates the angular position of the cam shaft 100. The jaw 4x is very slightly spaced from the jaw 2x as shown at "start" in FIG. 22 and also in FIG. 20, the jaws 2x and 4x thus defining a wire receiving window provided by co-operation between the mouth halves 300 and the openings 302 of the jaws 2x and 4x. The operator of the lead making machine now inserts the wire W through the wire receiving openings 302 guided by the mouth provided by the mouth halves 300, against the very weak action of the spring 311 ("wire in" in FIG. 22). As the cam shaft 100 comes under power as the motor 94 is started a lobe 312 of the cam 120x rapidly forces the lever 303 to swing in an anticlockwise sense as seen in FIG. 21, thereby forcing the jaw 4x down against the wire W ("wire gripped, and crimp" in FIG. 22). The downward force of the jaw 4x against the wire W is mitigated because the part 304 of the lever 303 swings slightly in the direction of the arrow Q with respect to the lever part 306, against the action of the return spring 310 as shown diagrammatically in FIG. 21. The wire stripping and the crimping operations are carried out whilst the lobe 312 is in engagement with the roller 196x. As the cycle of operation of the apparatus progresses, the roller enters a hollow 314 in the cam surface of the cam 120x so that the lever 303 straightens out under the action of the spring 310 and the jaw 4x is raised to a substantial extent, for example 10 to 15 mm, above the jaw 2x to the "wire out" position in FIG. 22. In order to allow maximum time for the wire to be withdrawn by the operator or the lead making machine, the motor 94 is slowed down under its electronic control as indicated in FIG. 23 as the end of the cycle approaches. Towards the end of the cycle, the roller 196x rides out of the hollow 314 whereby the jaw 4x is lowered to the "end" position in FIG. 22, whereafter the motor 94 is stopped, the jaw 4x being now in its start position. Since in the "wire out" position, the jaws 2x and 4x are widely spaced and ample time is allowed for the removal of the wire W, the ejector 28 and its operating mechanism are omitted thereby simplifying the construction of the apparatus. The wire gripping end parts of the jaws 2x and 4x are preferably exchangeable to allow for differences in wire gauges.

Figure 24:
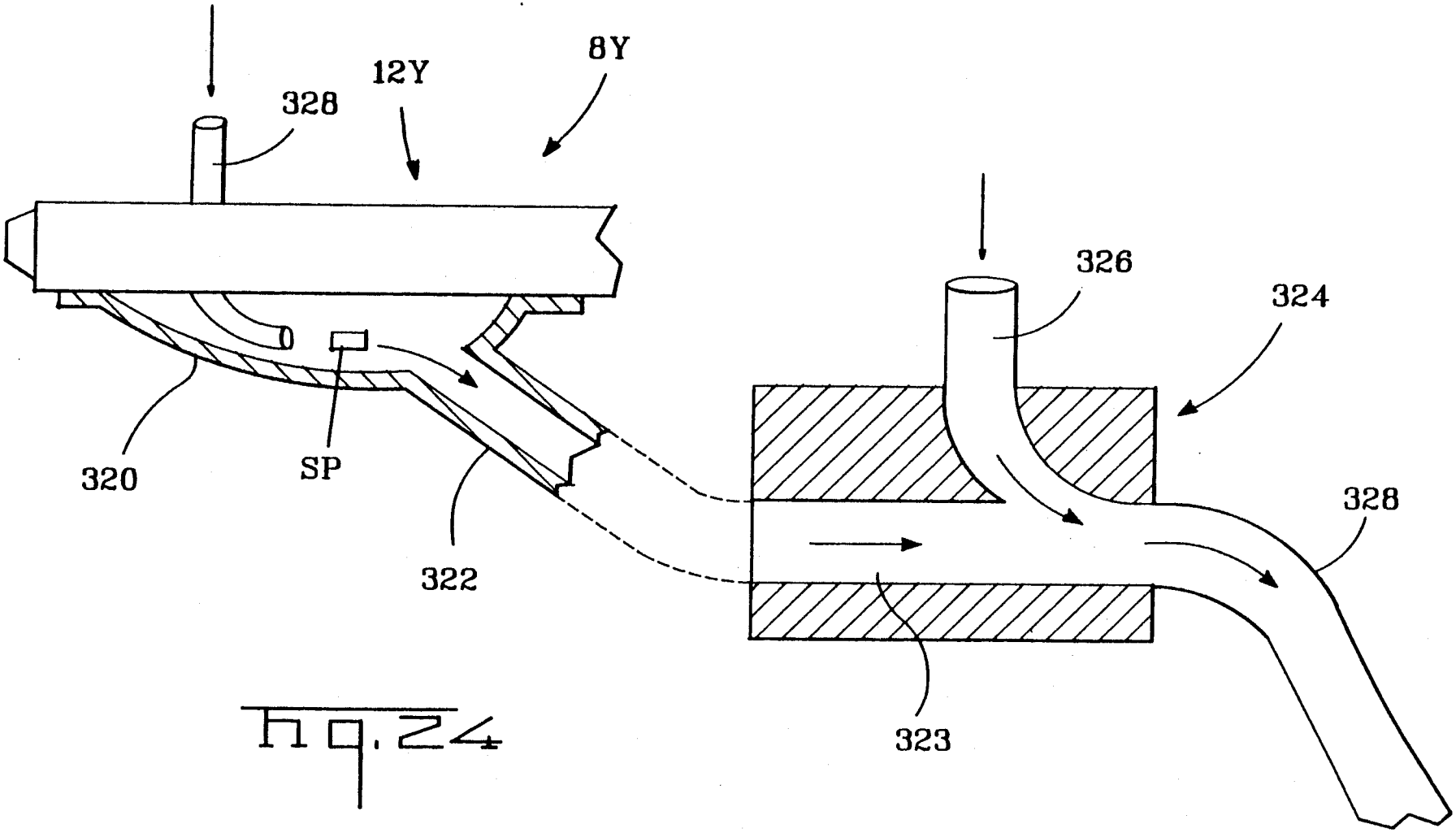
FIG. 24 is a diagrammatic side view shown partly in section illustrating means for ejecting severed portions of insulation from the stripper unit, according to the second embodiment of the invention.

An alternative means for ejecting several portions SP of insulation from the wire stripper unit will now be described with reference to FIG. 24, in which those parts having a similar function to those described above with reference to the first embodiment bear the same reference numerals thereas but with the addition of the suffix letter y.

In the wire stripper unit 8y, the ejector 66 and its associated mechanism, for ejecting several portions SP of insulation from between the arms of the stripper unit 8 are omitted. Instead thereof an insulation receiving cup 320 secured to the extension 246 (by means not shown) is arranged beneath the arms 12y of the unit 8y so that its upper edge engages the lower faces of the jaws 12y in their closed position, so that each portion SP of insulation removed from a wire W by the blades 14 falls into the cup 320. An exit tube 322 opening into the base of the cup 320 communicates with a through passage 323 of a venturi device 324 having a transverse compressed air inlet pipe 326 communicating the passage 323. A further compressed air inlet pipe 328 extending between the arms 12y has an outlet end proximate to the base of the cup 320. Compressed air supplied to the inlet pipe 326 causes a partial vacuum to be created in the tube 322 whereby the severed portion SP of insulation is sucked through the tube 322 and the passage 323 and is ejected from the apparatus by way of a downwardly extending ejection flexible pipe 330 connected to the passage 323. Compressed air supplied through the pipe 328 dislodges the severed portion SP should it stick to the base of the cup 320. The device 324 may also be secured to the extension 246.

We claim:

1. Apparatus for stripping the insulation from an end portion of an insulated wire and crimping an electrical terminal to the stripped end portion of the wire, the apparatus comprising a wire gripper unit having a pair of wire gripper jaws for gripping the wire at a position back from said end portion, a wire stripper unit for stripping the insulation from said end portion when the wire is gripped by said jaws, a crimping die and a crimping anvil which are relatively movable to crimp a terminal on the anvil to the stripped end portion of the wire, and a terminal feed unit for feeding the terminal onto the anvil, characterized in that the crimping die and the crimping anvil are both movable towards each other to crimp the terminal to the stripped end portion of the wire, the wire gripper unit being fixed and the terminal feed unit being movable towards the crimping die with the anvil, the crimping die being mounted on a first tool holder and the anvil being mounted on a second tool holder, said tool holders being slidable towards and away from each other by means of a first rotary cam acting upon a cam follower connected to toggle links each pivoted to a respective one of said tool holders, said feed unit being fixed to the second tool holder.

2. Apparatus as claimed in claim 1, characterized in that the wire gripper comprises wire gripping jaws cooperating to define a wire guiding window, in a wire receiving position of the jaws, said window being aligned with the wire stripper unit and said jaws being closely proximate to one another.

3. Apparatus as claimed in claim 2, characterized by a resiliently unidirectionally flexible lever connected to drive means for driving said jaws between said wire receiving position, a fully closed wire gripping position and widely open wire withdrawal position, said drive means urging said jaws against the wire against the resilient action of said lever, in said wire gripping position.

4. Apparatus as claimed in claim 1, characterized in that the wire gripper unit comprises a movable jaw and a fixed jaw and a wire ejector movably mounted on the said movable jaw, the movable jaw being displaceable away from the fixed jaw when the terminal has been crimped to the stripped end portion of the wire, thereby to actuate the wire ejector to eject the wire from between the jaws.

5. Apparatus as claimed in claim 4, characterized in that the wire ejector is pivoted to the movable jaw which is urged towards the fixed jaw by resilient means, a latch acting on the ejector to retain it in a retracted position whilst the wire is being gripped between the jaws, the latch causing the ejector to eject the wire, as the movable jaw is displaced away from the fixed jaw.

6. Apparatus as claimed in claim 1, characterized by a common drive motor for sequentially cycling said wire gripper unit, said wire stripper unit, said crimping die, said crimping anvil and said terminal feed unit; a common cam shaft driven by said motor; said first rotary cam on said shaft drivingly connected to said die and said anvil; a second rotary cam on said shaft drivingly connected to said stripper unit; and a third rotary cam on said shaft drivingly connected to said feed unit and to said gripper unit.

7. Apparatus according to claim 1, characterized in that a feed slide of said feed unit, which is driveable thereon in reciprocating motion to advance a terminal at a time onto said anvil is coupled to a first arm of a bell crank which is rockable to drive the feed slide, through the agency of a drive assembly, having an adjustment member which is adjustable lengthwise of a second arm of the bell crank, to determine the stroke length of the feed slide.

8. Apparatus according to claim 7, characterized in that said drive assembly is connected to said gripper unit to open the jaws thereof just before a terminal is fed onto the anvil by means of said feed slide.

9. Apparatus according to claim 1, characterized in that the wire stripper unit comprises a support block which is movable towards and away from the gripper unit, two opposed arms each terminating in an insulation severing blade extending from the support block towards the gripper unit, and being urged by resilient means towards a closed insulation severing position, and wedge means movable between said arms to drive them to an open wire receiving position after the terminal has been crimped to the stripped end portion of the wire.

10. Apparatus according to claim 9, characterized by a spring loaded ejector on one of said arms and an ejector cam for engaging the ejector as the support block is moved away from the gripper unit to eject a severed position of the insulation of the wire from between said arms.

11. Apparatus as claimed in claim 9, characterized in that the wire stripper unit comprises a cup secured beneath the arms for receiving severed portions of insulation of the wire, a suction pipe communicating with cup for removing said severed portions therefrom and ejecting them from the apparatus.

12. Apparatus according to claims 9, 10, or 11 characterized by a wire guiding ring fixedly interposed between said jaws of the gripper unit and the insulation severing blades, to guide a wire inserted between said jaws when in an open position, between said blades when in an open position.

13. Apparatus according to claims 9, 10, or 11 characterized in that said wedge means comprises a lever pivoted to said wire stripper unit and having a wedge cam thereon, a mechanism being provided for tilting said lever between a first position to engage said wedge cam between said arms thereby to move them to their open position and a second position to withdraw said wedge cam to allow said resilient means to move said arms to their closed position.

14. Apparatus according to claim 13, characterized in that said lever is pivoted to the wire stripper unit at one end, said wedge cam having a first cam surface for engaging a roller on one arm and a second cam surface for engaging a roller on the other arm, said cam surfaces being relatively angled to compensate for differential spacing of said rollers from the pivotal axis of said lever.

15. Apparatus according to any one of claims 9, 10, or 11, characterized by a driven rod connected to the support block for driving it towards and away from the gripper unit, a sleeve threadedly receiving an end of the rod being rotatable to adjust the end position of the support block.

16. Apparatus according to claim 15, characterized in that, the other end of the driven rod is pivoted to a driving crank, the sleeve and the other end of the rod extending through a pivotally mounted ball, the rod being movable through the ball by rotating the sleeve, to adjust the effective length of the driven rod.

17. Apparatus according to any one of claims 9, 10, or 11, characterized in that the resilient means is connected to the arms at relatively offset positions therealong to draw the blades against each other in the closed position of the arms.

18. Apparatus according to any one of claims 9, 10 or 11, characterized in that the die comprises a spring loaded wire holder housed in a recess therein and having a wire holding projection protruding across a crimping recess of the die for ensuring that the wire end portion is correctly positioned therein.

19. Apparatus according to any one of claims 9, 10, or 11, characterized by a floating shear block which is slidably arranged in juxtaposition with the anvil and has a recess for receiving a carrier strip connecting a plurality of terminals; and in that the die has thereon a tappet for depressing the shear block so as to sever the carrier strip, as the leading terminal of the carrier strip is being crimped to the stripped end portion of the wire between the die and the anvil.

20. Apparatus for stripping the insulation from an end portion of an insulated wire and crimping an electrical terminal to the stripped end portion of the wire, the apparatus comprising:

a wire gripper unit;

a wire stripper unit for stripping the insulation from the end portion when the wire is gripped by the wire gripper unit;

a crimping die and a crimping anvil which are movable toward each other to crimp the terminal to the stripped end portion of the wire;

the wire gripper unit being fixed and a terminal feed unit being movable toward the crimping die with the anvil; and the wire stripper and the crimping die and anvil are positioned on separate tool holders, the wire stripper unit is movable in a direction which is essentially perpendicular to the direction of movement of the dumping die and the anvil, such that the crimping die and anvil do not move in a direction along the longitudinal axis of the wire.

* * * * *